US009683434B2

(12) United States Patent
Machocki

(10) Patent No.: US 9,683,434 B2
(45) Date of Patent: Jun. 20, 2017

(54) APPARATUS AND METHOD FOR CONTROLLING A DOWNHOLE DEVICE

(71) Applicant: Oilsco Technologies Limited, Aberdeen (GB)

(72) Inventor: Krzysztof Machocki, Aberdeen (GB)

(73) Assignee: Oilsco Technologies Limited, Aberdeen (GB)

( * ) Notice: Subject to any disclaimer, the term of this patent is extended or adjusted under 35 U.S.C. 154(b) by 353 days.

(21) Appl. No.: 14/361,168

(22) PCT Filed: Nov. 28, 2012

(86) PCT No.: PCT/GB2012/052928

§ 371 (c)(1),
(2) Date: May 28, 2014

(87) PCT Pub. No.: WO2013/079929

PCT Pub. Date: Jun. 6, 2013

(65) Prior Publication Data

US 2014/0318806 A1 Oct. 30, 2014

(30) Foreign Application Priority Data

Nov. 28, 2011 (GB) ..... 1120448.4

(51) Int. Cl.
*E21B 44/00* (2006.01)
*E21B 23/00* (2006.01)
(Continued)

(52) U.S. Cl.
CPC ..... *E21B 44/005* (2013.01); *E21B 21/103* (2013.01); *E21B 23/006* (2013.01); *E21B 34/10* (2013.01)

(58) Field of Classification Search
CPC ..... E21B 23/06; E21B 23/006; E21B 21/03; E21B 34/10
See application file for complete search history.

(56) References Cited

U.S. PATENT DOCUMENTS 3,024,845 A * 3/1962 Conrad ..... E21B 23/06 166/123
3,519,075 A * 7/1970 Mullins ..... E21B 34/125 166/150

(Continued)

FOREIGN PATENT DOCUMENTS

CA 2093331 C * 8/2001 ..... E21B 23/006
EP 0870901 A2 10/1998

(Continued)

OTHER PUBLICATIONS

International Search Report and Written Opinion, PCT Application No. PCT/GB2012/052928 dated Feb. 28, 2014, 10 pgs.

(Continued)

*Primary Examiner* — Jennifer H Gay
(74) *Attorney, Agent, or Firm* — Dennis A. Bennett; Chris Marion

(57) ABSTRACT

Apparatus for controlling a downhole device in a well has a body with a control slot and pin movable in the slot. The slot has a first inactive loop in which the pin can cycle between different idling configurations, and a second active loop in which the pin can move between different configurations which correspond to active and inactive configurations of the downhole device. The pin can be switched between the first and second loops, and can cycle between the different configurations within without switching between the different loops. The slot can be provided on a piston, and the axial movement of the piston in the bore can drive the relative movement of the pin and the slot.

35 Claims, 17 Drawing Sheets

(51) Int. Cl.
*E21B 34/10* (2006.01)
*E21B 21/10* (2006.01)

(56) References Cited

U.S. PATENT DOCUMENTS 3,735,827 A * 5/1973 Berryman ..... E21B 31/113 166/178
3,797,591 A * 3/1974 Berryman ..... E21B 31/113 175/296
3,831,677 A * 8/1974 Mullins ..... E21B 23/006 166/128
4,355,685 A * 10/1982 Beck ..... E21B 23/006 166/240
4,491,187 A * 1/1985 Russell ..... E21B 10/322 175/325.2
4,650,001 A * 3/1987 Ringgenberg ..... E21B 23/006 166/240
5,890,542 A * 4/1999 Ringgenberg ..... E21B 21/10 166/321
6,227,298 B1 * 5/2001 Patel ..... E21B 23/006 166/313
6,352,119 B1 * 3/2002 Patel ..... E21B 23/006 166/332.2
6,883,612 B2 * 4/2005 Ferguson ..... E21B 23/006 166/105
8,453,760 B2 * 6/2013 Fincher ..... E21B 21/103 175/25
8,863,843 B2 * 10/2014 Wu ..... E21B 10/32 166/319
8,936,099 B2 * 1/2015 Hu ..... E21B 10/322 166/320
9,068,417 B2 * 6/2015 Swenson ..... E21B 23/006
2004/0140087 A1 * 7/2004 Ferguson ..... E21B 23/006 166/68.5
2011/0048802 A1 * 3/2011 Fincher ..... E21B 21/103 175/48
2011/0114324 A1 * 5/2011 Hayter ..... E21B 23/04 166/331
2011/0284233 A1 * 11/2011 Wu ..... E21B 10/32 166/321
2012/0199363 A1 * 8/2012 Hu ..... E21B 10/322 166/373
2013/0105172 A1 * 5/2013 Swenson ..... E21B 23/006 166/370
2014/0318806 A1 * 10/2014 Machocki ..... E21B 23/006 166/373
2015/0240593 A1 * 8/2015 Stolboushkin ..... E21B 23/006 166/320
2016/0130897 A1 * 5/2016 Machocki ..... E21B 23/006 166/244.1

FOREIGN PATENT DOCUMENTS

GB 2381550 A 5/2003
GB 2381550 B * 6/2003 ..... E21B 23/006
WO 9831915 A2 7/1998

OTHER PUBLICATIONS

International Preliminary Report on Patentability, PCT Application No. PCT/GB2012/052928 dated Jun. 12, 2014, 7 pgs.

* cited by examiner

APPARATUS AND METHOD FOR CONTROLLING A DOWNHOLE DEVICE

CROSS REFERENCE TO RELATED APPLICATIONS

This application is a U.S. national stage filing under 35 U.S.C. §371 of PCT International Application No. PCT/GB2012/052928, filed Nov. 28, 2012, which claims the benefit of priority to Great Britain Application No. 1120448.4 filed Nov. 28, 2011. Each of the above-referenced applications is expressly incorporated by reference herein its entirety.

The present invention relates to a method and apparatus for controlling downhole devices.

It is necessary to control the actions of downhole valves and other tools from the surface. Valves or other downhole tools frequently need to be opened and closed at different stages of drilling, operating and maintaining a wellbore, so controllers to achieve the remote opening and closing of the valve in the well are needed.

Activation and de-activation of downhole devices often involve steps such as dropping activation or deactivation balls from the surface. One disadvantage of these methods is that time between dropping the ball from the surface and the ball landing on the designated tool seat is a variable factor in the method. For very long wells it can take e.g. up to 40 minutes to switch a tool on and another 40 minutes to drop a second ball to switch the tool off. These methods also limit the number of on/off cycles that are possible because the number of balls that can be dropped and retained in the ball catcher is limited, and once the ball catcher is full, the tool must be retrieved to the surface and the ball catcher must be emptied before the tool can be re-set.

It is also well known to control tools in the well using pressure changes transmitted via fluid in the wellbore, which shuttles a sleeve axially relative to a pin. Such arrangements are typically called J-slot devices, as the sleeve is slotted with a J-shaped slot in which the pin moves. The sleeve is caused to rotate relative to the stationary pin which is constrained to travel along the J-shaped slot. When the pressure is increased, the sleeve moves down, the pin is at one position in the slot, and the valve is open for example, and when the pressure is decreased, the sleeve moves up relative to the pin, which is guided into another relative position of the pin and the slot, in which the valve can be closed. The slot can be formed in a loop around the sleeve, with the two ends of the loop connected, so that the sleeve continually moves around its axis sequentially opening and closing the valve. The pressure acting on the sleeve can be wellbore pressure or can be control line pressure.

According to the present invention there is provided apparatus for controlling a downhole device in an oil, gas or water well, the apparatus having a body comprising a control slot engaging a pin, the control slot and the pin being provided on separate parts that are movable relative to one another, such that movement of the pin relative to the control slot switches the downhole device between active and inactive states, the slot having a first loop wherein the pin can move between different idling configurations of the pin and slot in which the device is inactive, and a separate second loop spaced around the body with respect to the first loop, and wherein the pin can move in the second loop between different configurations of the pin and slot which correspond to active and inactive configurations of the downhole device, and wherein the pin can be switched between the first and second loops, and wherein the pin can cycle between the different configurations within each of the first and second loops without switching between the first and second loops.

The invention also provides a method of controlling a downhole device in an oil, gas or water well, the apparatus having a body comprising providing a control slot and a pin on separate relatively movable components so that the slot engages the pin and the pin and slot are movable relative to one another, and moving the pin relative to the slot to switches the downhole device between active and inactive states, wherein the method comprises moving the pin in a first loop of the slot wherein the loop defines different idling configurations of the pin and slot in which the device is inactive, and moving the pin in a second separate loop of the slot spaced around the body with respect to the first loop, wherein the second loop defines different configurations of the pin and slot which correspond to active and inactive configurations of the downhole device, and wherein the method includes the step of switching the pin between the first and second loops and cycling the pin between the different configurations within each of the first and second loops without switching between the first and second loops.

Typically the pin can remain in one of the first and second loops without switching between them, moving between different configurations of the pin and slot within each loop. Typically the pin cycles repeatedly between the two different configurations of the pin and slot within each loop, moving repeatedly from one to the other until switched between the loops. Typically the pin cycles from the origin of each of the first and second loops to a second position in the loop and back to the origin of the same loop. The first and second loops can be connected to third or further loops or tracks that may have the same or different functions. Accordingly such third and further loops may optionally allow cycling in the same was as the first and second loops, but provided that the first and second loops allow cycling, it is not necessary for other loops or tracks to do so.

Typically the geometry of the slot restrains the movement of the pin within one of the loops until switched.

Typically each of the loops comprises a first track and a second track, wherein the second track returns the pin to the starting point of the first track. Typically the pin normally moves in opposite axial directions in the two tracks. Typically the pin can be switched between the first and second loops on the second return track. Typically the switching is achieved by reversing the relative axial direction of movement of the pin and slot, typically by reversing the axial direction of movement of a sleeve in which the slot is formed. Typically the switching is accomplished when the pin is in a transition portion of the second return track, typically having passed a junction (typically a Y-junction) leading to the next loop. Typically the y-junction is inverted, and the switching between loops is accomplished when the pin is in the combined trunk of the y, heading away from the junction between the connecting upper limbs of the y. Typically the two limbs of the y are parts of different respective loops. Typically one of the limbs (e.g. the limb connected to the second loop) is in axial alignment with the trunk of the y.

Typically the body comprises a piston responsive to pressure changes in the well, and axially movable in a bore in the apparatus in response to said pressure changes. Typically the axial movement of the piston in the bore drives the relative movement of the pin and the slot.

Typically the slot can be provided on a sleeve that moves relative to the body, and the pin can be provided on the body, but in other embodiments, the sleeve can have the pin and the slot can be provided on the body. The sleeve can typically be formed integrally with the piston. Thus the piston can optionally bear the slot, or it can be formed on a separate sleeve that is connected to the piston.

Typically the start and end of the first and second tracks, where the pin switches between the two tracks, are spaced apart axially along the sleeve/piston and/or they can optionally be spaced circumferentially, but in certain embodiments the start and end of the first and second tracks in each loop can be axially aligned along the axis of the body. The end point of each track, corresponding to the start point of the other track, is typically formed at a corner of the slot, which guides the change in the direction of movement of the pin relative to the slot, typically forming a stop that requires reversal of the axial direction of movement of the pin relative to the slot. For example, the first track can start at one end of the sleeve or piston, e.g. the lower end, and can extend axially up the sleeve/piston (typically with a lateral or circumferential component in addition to the axial component) to the end of the first track provided in the form of an inverted V at a position that is axially spaced apart on the sleeve/piston from the starting position of the first track, e.g. at or near to the top of the sleeve/piston. The inverted V marks the transition between the first and second tracks. From the apex of the inverted V, the pin is constrained to move down the second track.

Typically the first and second tracks have first portions that are typically linear (e.g. axial) and are typically arranged parallel to the axis (e.g. the axis of the body or sleeve and piston), and which do not drive relative rotation of the pin and slot components; and second portions, which typically also incorporate straight lengths but can also be deviated away from the first portion, and so typically extend axially and circumferentially, thereby driving rotation of the pin and slot components (typically driving the sleeve/piston relative to the stationary pin) in accordance with the angle of the deviation of the second track in relation to the axis. In some embodiments, both the first linear and second deviated portions can optionally be angled with respect to the main axis of the piston/sleeve. Such embodiments can optionally have deviated portions also, but typically the second deviated portions are set at a greater angle than the first linear portions to drive a greater rotation of the sleeve than the linear portions. Typically where the whole slot is angled (to a greater or lesser extent) then the movement of the pin through the slot will drive continued rotation of the piston around its axis, and the extent of rotation will typically vary in accordance with the angle of the linear and deviated portions of the slot with respect to the axis.

Typically the switching is accomplished when the pin is in a transition portion of the second return track. The transition portion of the second return track is typically an axial portion. Typically the switching is triggered by reversal of the direction of movement of the pin in the axial portion of the slot. Typically the axial transition portion is adjacent to the Y-junction in the slot, between the two loops, and typically the reversal of the movement of the pin in the transition portion of the slot causes the pin to move from one loop to the other.

Typically the slots comprise spaced apart end portions, each having blind ended tracks (typically extending axially) and deviated portions that typically deviate from the axis of the apparatus and axial transition portions. Typically at least part of the transition portion (typically the axial transition portion) of one second (return) track forms part of the first (outward) track of the adjacent loop.

Typically the apparatus comprises alternating loops spaced circumferentially around the sleeve/piston. Normally the loops are arranged in pairs. Simple embodiments of the invention can comprise merely one first and one second loop, and the pin can transition between the two loops, idling in the first loop, and switching between active and inactive in the other. However, in other embodiments of the invention, it is possible to have multiple pairs of first and second loops, optionally alternating in a sequence (e.g. first-second-first-second etc.) around the circumference of the sleeve or piston. Thus in such embodiments, the pin can idle in a first loop, switch to a second loop where it can move the device between active and inactive positions, and then move into another (optionally a different) first loop to idle once more before being switched into a (optionally different) second loop. 2, 3 4 or more pairs of first and second loops can optionally be provided in some embodiments. The different first loops can optionally have the same or different characteristics but typically they all have the same characteristics of idling between different positions of the sleeve/piston without activating the device. Likewise the different second loops can have the same or different characteristics, and optionally more variation in characteristics can be seen in different second loops, as these can, in some embodiments of the invention, be configured to switch between different active states of the device, for example, one second loop can switch between closed and 50% open, and another second loop can switch between closed and 75% open, etc.

In certain embodiments, instead of being arranged in pairs of first and second loops, the loops can be arranged in triplets, and the pin can cycle from first to second to third and optionally subsequent further loops before typically returning to the first loop and repeating the cycle. The third, fourth, fifth, and subsequent loops can optionally be chosen to correspond to the same or different configurations of the device, for example, the second loop can switch between e.g. closed and 50% open, and the third loop can switch between closed and 75% open, etc. or some different state of activation as compared with the second loop, after which the pin can optionally return to the first loop, or progress to another loop or series of loops that can optionally have different structural characteristic which set the tool in different configurations that provide different functional effects on the tool being controlled. Different embodiments can optionally have different configurations at the transitions of the slots.

Typically the speed of movement of the pin in the first track is different from the speed of the pin in the second return track, typically in each loop, or at least in the second loop. Typically the pin moves more slowly in the second track of the slot than in the first track. The movement of the pin through the first track is typically as quick as possible. However, the movement of the pin through the second (return) track is optionally deliberately slowed in order to provide a larger time window for triggering reversal of the direction of movement of the pin in the second track of the slot. This provides more time to trigger the transition between the two loops, which can then be accomplished more easily and more accurately, and typically using conventional surface apparatus, such as surface pumps. Typically the difference in speed between the two tracks can be controlled by hydraulic means, for example, by providing different fluid pathways for flow of fluid when moving the pin in the respective first and second tracks. For example, the pin can move more slowly in the second track than in the first because the fluid forcing movement of the pin in the second track can have a flow restrictor in the fluid pathway, whereas the fluid driving the pin through the first track can optionally typically move through higher capacity pathways with less resistance to fluid flow. Optionally the fluid flow pathways in each of the first and second tracks can be structurally the same, and the speed differential is controlled by functional steps, for example, applying different pressures during passage of the pin through each of the tracks, to move the pin more slowly through the second track than through the first.

Optionally, different portions (e.g. the deviated and axial portions) of the second track have different characteristics concerning the maximum possible speed of movement of the pin in those portions, and in typical embodiments of the invention, the pin can optionally move more quickly through at least one of the deviated portions of the second track than through the axial portion. Therefore, these differential limits on speed of movement of the pin through the slot permit the quick movement of the pin to the point at which transition occurs between the two loops, and then a controlled, slower movement through the transition zone of the slot allowing more time (e.g. several minutes) to trigger changes from surface in order to switch the pin between adjacent loops, optionally followed by a quicker movement back to the starting point of the first track after the pin has passed the transition point at which switching between loops is possible.

Optionally the speed restrictors are fluid flow restrictors where the driving force moving the pin through the slot is hydraulic, but in other embodiments where the motive force for the movement of the pin through the slot is something else, then the speed restrictors can comprise other suitable components.

Optionally the apparatus is used to operate a valve, for example to move a sleeve/piston in order to open or close one or more ports to allow or restrict or choke fluid flow, for example in a circulation valve. Optionally the apparatus is used to operate a cutting tool, for example to move a sleeve/piston in order to cause a cutting element to extend from a body of the tool, for example in a reaming tool such as an under-reamer. The loops can be set up to allow the operator to circulate fluid though the tool without expanding cutters while in first loop. The second loop can be configured to move between unexpanded and partially expanded cutter positions i.e. 50% expanded, and the third loop can be configured to move between unexpanded and a different configuration e.g. 100% expanded. Embodiments of the apparatus can also be used to extend and recover the blades of stabilisers. Many other uses of the apparatus are possible.

It is particularly beneficial that the apparatus allows cycling between different idling configurations without necessarily activating the tool it is controlling. This allows operation of other pressure-activated tools in the string independently of the apparatus controlled by embodiments of the invention. Also, it permits a string incorporating apparatus of the invention to be broken and made up at the surface to add or remove stands of pipe to the string without affecting the configuration of the device, for example, without switching the device between inactive, partially or fully active configurations, until the pin is switched between the first and second loops at the desired time selected and controlled by the operator.

Typically the apparatus comprises a conduit passing through a body, allowing passage of fluid through the conduit past the apparatus. Optionally the body bore can be aligned with the bore of a string in which the apparatus is incorporated.

Typically the piston can be moved by fluid pressure in the bore of the body. Typically the bore allows transmission of the fluid pressure past the apparatus in the string in order to activate other tools in the string.

Optionally the sleeve/piston can be biased by a resilient device, such as a spring, e.g. a coiled spring, in one axial direction, and the fluid pressure (or other motive force driving the movement of the pin in the slot) can act in the opposite direction, against the force of the resilient device. Therefore, the sleeve/piston can typically be biased in one direction, e.g. upwardly, and the apparatus can optionally be activated by applying fluid pressure (or other motive force) to move the sleeve/piston down against the force of the resilient device.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing" or "involving", and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa.

Figure 30A:
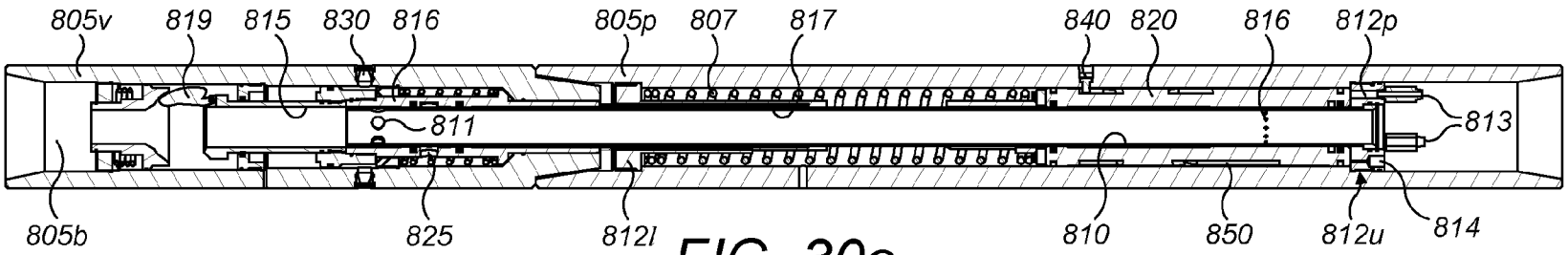
Figure 30B:
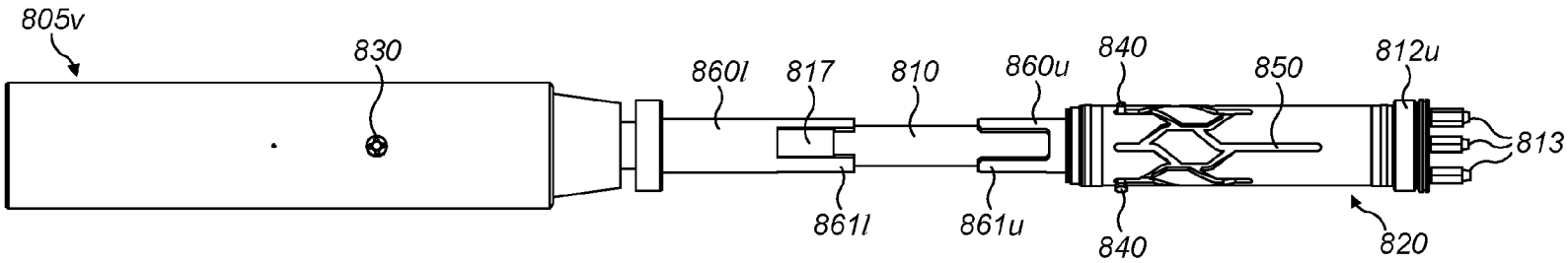
Figure 31A:
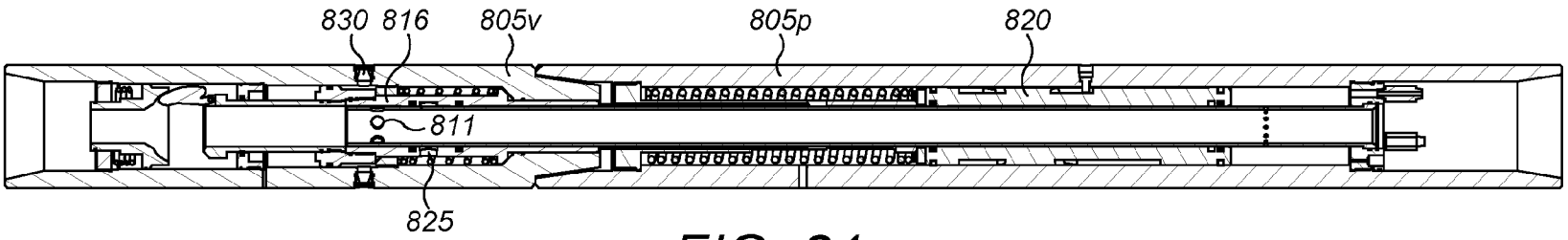
Figure 32A:
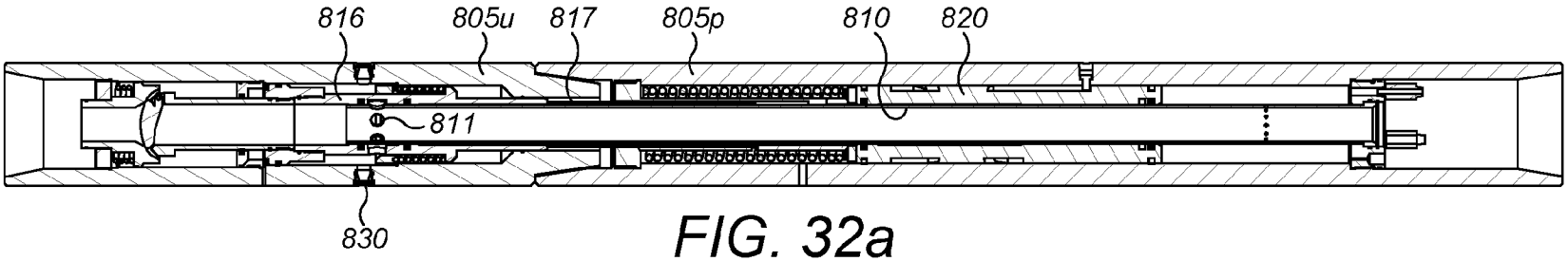
Figure 33A:
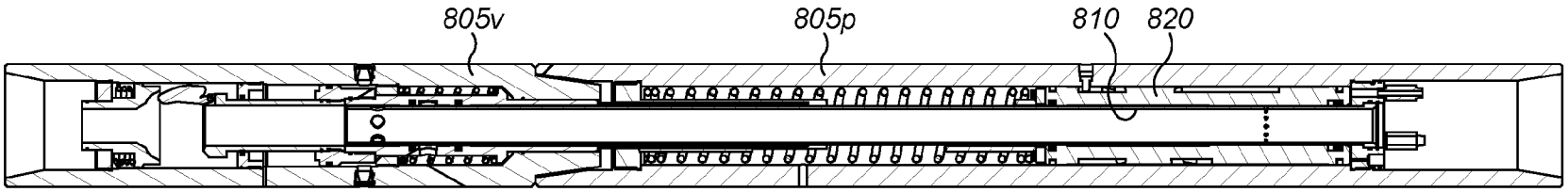

FIGS. 30*a* and *b* show a further example of a tool in section and partial side view in a first inactive configuration with no pressure applied to it and the pin in the first (inactive) loop;

FIGS. 31*a* and *b* show similar views of the FIG. 30 tool in a second inactive configuration under pressure, with the pin in the first loop;

FIGS. 32*a* and *b* show similar views of the FIG. 30 tool in a first active configuration, where the tool is under pressure and the pin is in the second (active) loop; and FIGS. 33*a* and *b* show similar views where the tool is not under pressure, and the pin is in the second loop.

Figure 1:
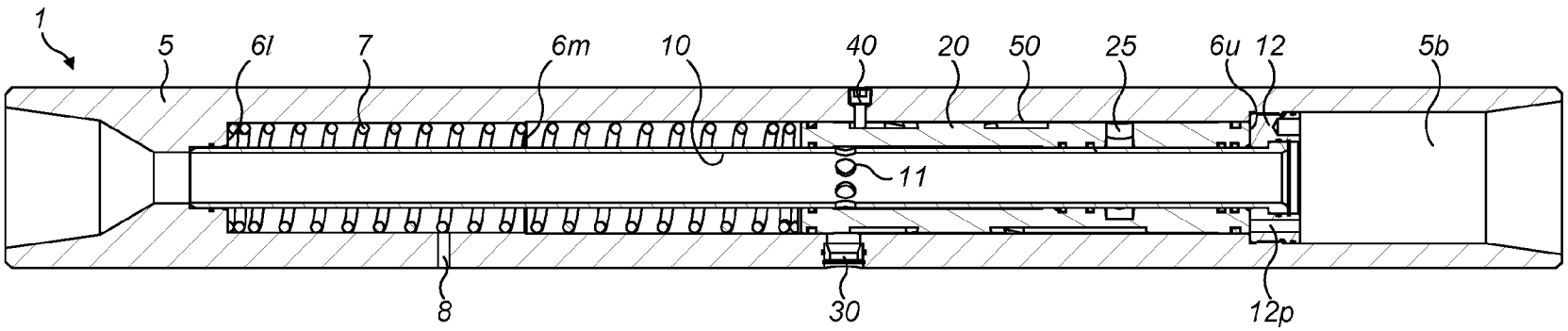
FIG. 1 is a side sectional view of a first circulation tool incorporating apparatus according to the invention, in a first closed configuration in which the pin is in the first loop, and the circulation tool is closed.

Referring now to the drawings, FIG. 1 shows a first example of apparatus for controlling a downhole tool in accordance with the invention, in cross-section view. The apparatus of FIG. 1 comprises a control sub 1 with a body 5 having box and pin connections at respective ends adapted to connect the body 5 into a string of an oil or gas well. The string can typically comprise a number of tubular devices connected end to end above and below the control apparatus 1. As shown in the Figures, in this example, the apparatus 1 is connected in the string so that the left hand end of the body 5 is furthest down the hole, and the right hand side of the body 5 is nearer the surface, but different arrangements can be adopted in other examples. The body 5 has a central bore 5*b* having three upwardly facing shoulders, a first shoulder 6*u* adjacent an upper end, and a second shoulder 61 adjacent a lower end, and a smaller middle shoulder 6*m*. The bore 5*b* passes between the two ends of the body 5 allowing passage of fluid through the body 5. A flow tube 10 extends axially through the body 5, being co-axial with the main axis of the bore 5*b*, and having a restricted inner diameter, similar to the inner diameter of the bore 5*b* below the lower step 6*l*. The flow tube is sealed on its outer surface at the bottom of the flow tube 10, and is typically screwed and sealed into an internal thread in the throat of the bore 5*b* below the lower step 6*l*, and at its upper end, is held in place by a collet or circlip that engages a collar 12, which typically screws into an internal thread on the inner surface of the larger diameter section of the bore 5*b* above the first step 6*u*. Therefore, the flow tube 10 is typically secured co-axially in the bore 5*b*. Instead of screw threads, the flow tube 10 can optionally be connected in the inner bore by means of a collet or circlip arrangement. In this example, the flow tube 10 is typically screwed mechanically in the body 5 only at the bottom and is retained at the top by the collar 12, but alternatively it could be retained by a screw thread or a collet at each or either end.

The flow tube 10 defines an annulus between the outer surface of the flow tube 10 and the inner surface of the bore 5*b* within the body 5. Within the annulus, a spring 7 is provided in the lower part of the tool. The spring 7 bottoms out on the upwardly facing surface of the lower step 61. Typically, the spring 7 is held in compression by a piston 20 set within the annulus above the spring 7, and surrounding the upper part of the flow tube 10. The compression of the spring 7 between the upwardly facing surface of the lower step 6*l* and the downward facing surface of the piston 20 pushes the piston 20 upwards within the annular space, compressing it against the lower face of the collar 12. The force of the spring 7 is typically chosen to be relatively weak in its expanded configuration shown in FIG. 1, and the spring force is designed to allow fluid pressure in the annulus above the piston 20 to overcome the force of the spring 7 and allow the piston 20 to move axially within the annulus, as will be described below. The piston 20 is typically sealed on its inner and outer faces, to ensure that it moves with the force of fluid within the annulus, preventing passage of fluids. Sliding movement of the piston within the annulus to compress the spring typically exhausts fluid below the piston through an exhaust vent 8, which helps to avoid piston lock.

The body has a number of circumferentially spaced circulation ports 30, which are arranged at the same axial position, but at different circumferential positions around the body 5. These are aligned axially with ports 11 passing through the wall of the flow tube 10. The circulation ports 30 extend through the wall of the body 5, and allow fluid communication between the bore 5*b* of the body, and the outer surface of the body 5 in certain circumstances. However, in the position shown in FIG. 1, the inner surface of the ports 30 (and the outer surface of the ports 11) is occluded by the piston 20 which is sealed above and below the axial position of the ports 11, 30, thereby preventing fluid communication between the bore 5*b* and the outside of the body when the piston 20 is in the position shown in FIG. 1.

The piston 20 has a set of circumferentially spaced ports 25, which have the same circumferential spacing as the circulation ports 30 in the body 5. The flow tube 10 also has a number of ports 11 spaced around its circumference. In other examples, the circumferential spacing pattern of the ports 11 in the flow tube 10 can be the same or different to the spacing pattern of the ports 30 in the body 5. In this example, the ports 11 are aligned with the ports 30. However, the axial position of the ports 11 in the flow tube 10 is such that the ports 25 in the piston 20 only align axially with the ports 11 when the lower face of piston 20 bottoms out on the shoulder 6*m*. The ports 25 on the piston 20 are similarly arranged at a common axial location on the piston. Movement of the piston 20 to slide down the bore 5*b* to compress the springs therefore brings the ports 25 in the piston 20 into axial alignment with the ports 30 in the body 5, and with the ports 11 through the flow tube 10, which opens the flow path for communication of fluid between the bore 5*b* of the body 5, and the outside surface of the body.

Figure 8:
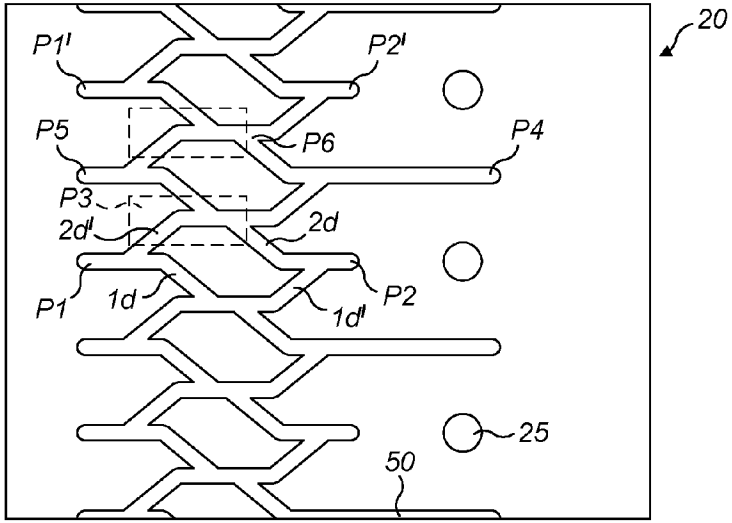
FIG. 8 is a schematic plan view of the slot of the FIG. 1 apparatus, as if the surface of the piston were split axially along the line A-A of FIG. 9 and unrolled into a flat plane.
Figure 10:
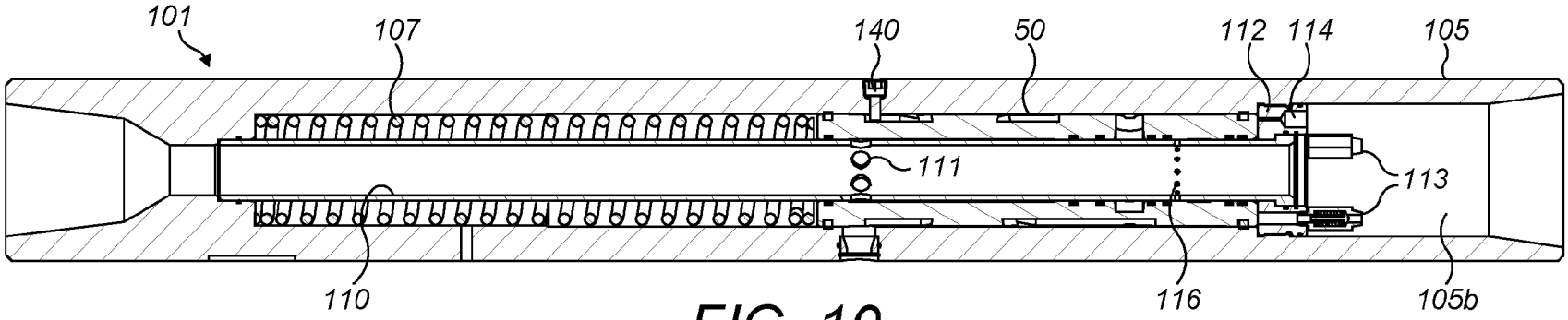
FIG. 10 is a side sectional view of a second circulation tool incorporating apparatus according to the invention, in a first closed configuration in which the pin is in the first loop, the bore pressure is low, and the circulation tool is closed.
Figure 11:
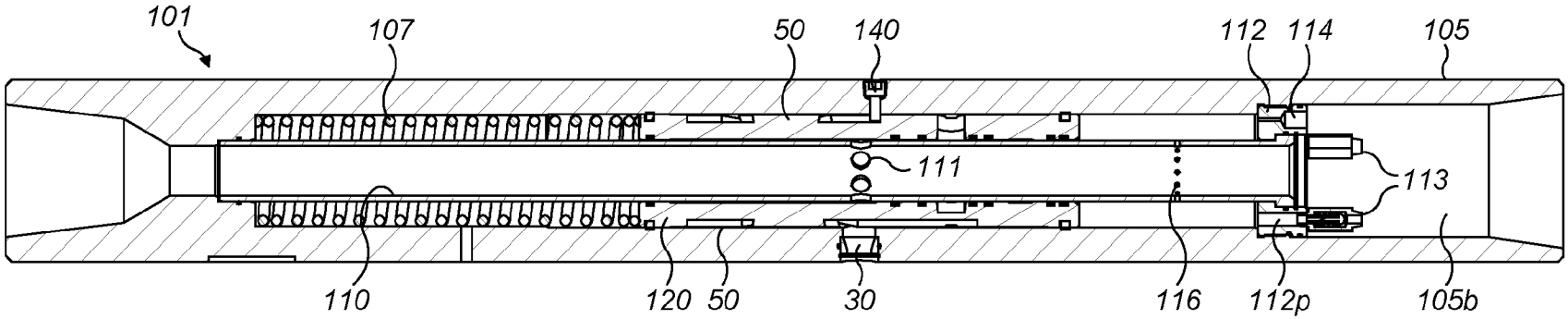
FIG. 11 is a side sectional view of the circulation tool of FIG. 10, in a second closed configuration, in which the pin is still in the first loop, the bore pressure is high, and circulation tool is again closed.
Figure 12:
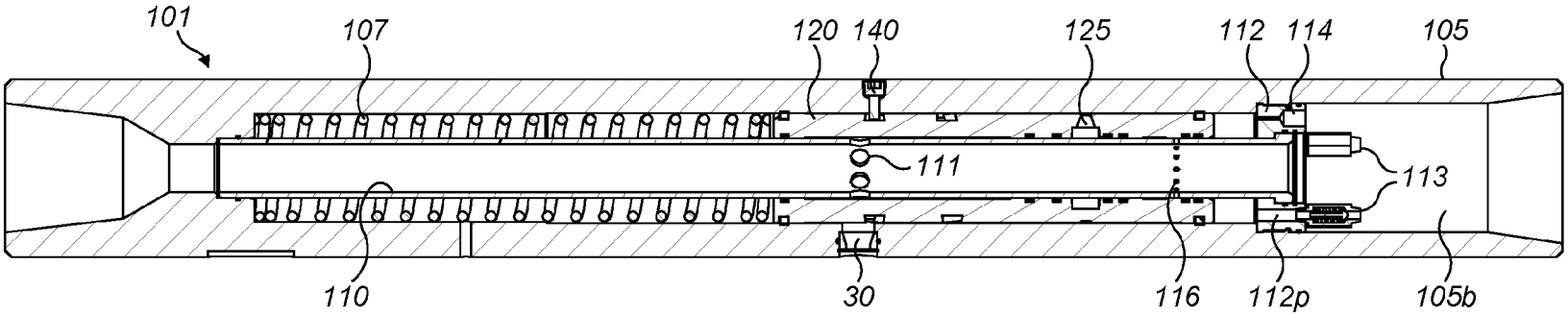
FIG. 12 is a side sectional view of the circulation tool of FIG. 10, in a third transitional configuration, in which the pressure is decreasing, and the pin is about to switch from the first loop into the second loop.
Figure 13:
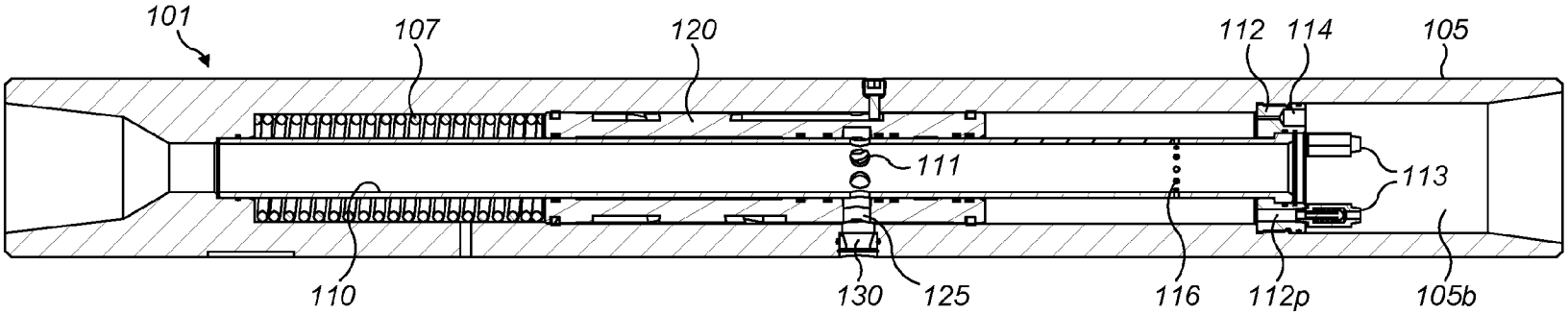
FIG. 13 is a side sectional view of the circulation tool of FIG. 10, in first open configuration, in which the pin is in the second loop, the pressure is high, and the circulation tool is open, allowing fluid circulation.
Figure 14:
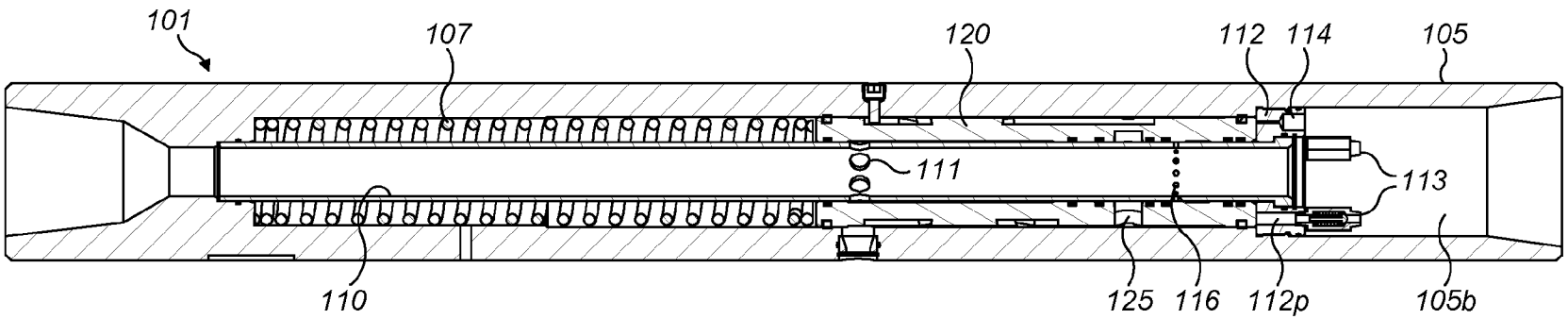
FIG. 14 is a side sectional view similar to FIG. 11, with the circulation tool in the closed configuration at low bore pressure, but in which the pin is in the second loop.
Figure 15:
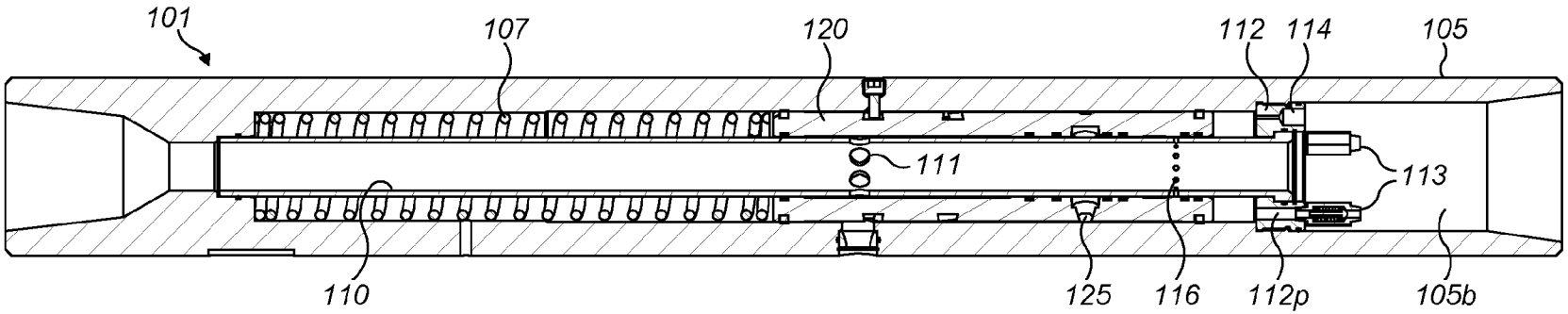
FIG. 15 is a side sectional view similar to FIG. 12, where the pressure is decreasing and the pin is about to transition into an adjacent first loop.

The movement of the piston 20 within the bore 5*b* is regulated by a pin and slot arrangement, constraining the extent of axial movement of the piston 20 within the bore 5*b*, and guiding rotation of the piston around its axis. The piston 20 is in the form of sleeve having an axial bore, and in this example, the control slot is formed on the outer surface of the piston. The pin and slot arrangement is shown in FIG. 8. In this example, the pin 40 is inserted through a threaded bore passing laterally through the side wall of the body 5, and extends into the bore by a short distance, sufficient to engage the slot 50 and to retain the pin 40 within the slot 50 as the piston 20 moves up and down. The slot 50 is typically provided on the outer surface of the piston 20. In alternative examples, the slot can be provided on a separate sleeve that can be separately connected to the piston, or alternatively the piston can be provided with a pin, that extends laterally outwards into an inwardly facing slot provided on the inner surface of the bore, or on a separate sleeve connected with the bore. The pin and slot arrangement can be provided on the sub 1 of the apparatus, but this is not essential, and the pin and slot arrangement can be provided on a separate component.

The slot 50 in the sub 1 has at least two loops i.e., the slot has a first loop allowing the pin 40 to move between different configurations that define two different closed configurations of the piston 20, where the ports 25 through the piston are not aligned with the ports 30 through the body 5 and the ports 11 through the flow tube 10, and fluid communication does not take place, and a second loop, in which the pin 40 cycles between two different positions in the slot 50 corresponding to different configurations of the piston 20 in which fluid flow through the ports 30 is either allowed or disallowed. The pin 40 can be switched between the two loops at a time of the operator's choosing as will now be described, but also allows repeated cycling between the two configurations on each loop without necessarily switching between the two loops until the operator chooses to do so. Therefore, the device can be cycled between different inactive configurations where, in both configurations, the outer ports 30 are closed and no fluid communication takes place through them; but at a time of the operator's choosing, the pin and slot arrangement can be switched to track the pin through the second loop, and allow opening and closing of the outer ports 30.

Fluid pressure in the bore 5*b* is communicated to the piston 20 by means of an axial port 12*p* passing in an axial direction through the collar 12, thereby providing a fluid communication pathway between the bore 5*b* and the annulus between the flow tube 10 and the inner surface of the bore 513. The inner and outer surfaces of the piston 20 are sealed above and below the ports 25. Therefore, pressure changes in the bore 5*b* are transmitted to the upper face of the piston 20 through the port 12*p*, thereby causing axial sliding movement of the piston 20 in response to pressure changes, e.g. to compress the spring 7 when the pressure is sufficiently high to overcome the spring force. Rotation of the piston around the flow tube 10 is governed by the constraint of the pin 40 within the slot 50, which cams the piston.

FIG. 1 shows the resting position of the control sub 1, in which the bore 5*b* is not pressurised, and the spring 7 is pushing the piston 20 up the annulus against the lower end of the collar 12. The counteracting force restraining the piston 20 against further axial movement is typically borne by the collar 12; although the pin 40 as shown in FIG. 1 is at the bottom end of the slot 50 on the outer surface of the piston 20, typically, the length of the slot 50 is engineered so that the force retaining the piston 20 is held by the thread securing the collar 12 in place on the inner bore of the body 5, and the pin 40 can be rated simply to guide the rotation of the piston 20 rather than also needing to retain the piston 20 against axial movement when the pressure is high. Typically, the spring force is relatively weak (approximately 300 ftlb at minimum compression and 1000 ftlb at maximum compression). As pressure is increased within the bore 5*b*, the fluid pressure is communicated through the port 12*p*, which pushes the piston 20 down within the annulus as shown in FIG. 2.

As is best seen with reference to FIG. 8, the pin 40 starts at point P1 on FIG. 8, at the lower end of a blind ended axial portion of the slot 50. As the piston 20 starts to move down relative to the stationary pin 40, the pin 40 tracks axially up the blind end of the axial portion and enters a deviated portion 1*d* which causes clockwise rotation of the piston 20 relative to the stationary pin 40 as the pin tracks anti-clockwise through the deviated portion. A further axial portion stops the rotation but guides the axial movement of the piston 20 until the slot 50 enters a further deviated portion 1*d*' this time tracking in a clockwise direction towards a further blind ended axial portion of the slot, which terminates at position P2, corresponding to the position of the slot 40 shown in FIG. 2. The tracking of the pin 40 from the first blind ended axial bore, through the first anti-clockwise deviation 1*d*, through the first axial transition to the second deviated clockwise track 1*d*' and finally leading to the second blind ended axial bore at P2 is the first track of the first loop of the slot 50.

Figure 2:
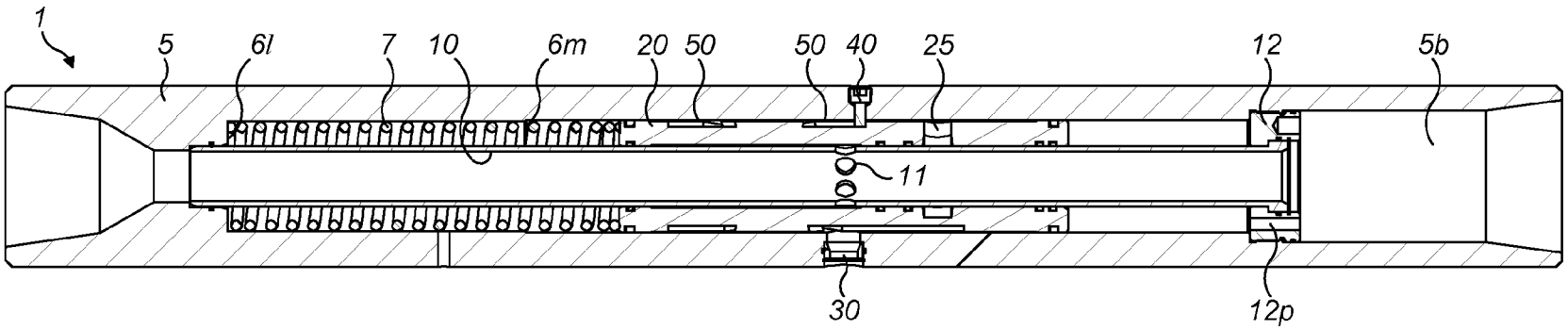
FIG. 2 is a side sectional view of the circulation tool of FIG. 1, in a second closed configuration, in which the pin is still in the first loop and the circulation tool is again closed.

In the position shown in FIG. 2, the pin 40 has tracked to the upper end of the first track in the first loop, terminating at position P2 shown in FIG. 8. At this position the piston is restrained against further axial upward movement. Therefore, the ports 25 do not come into register with the ports 11, 30, and fluid circulation cannot take place. As fluid pressure is backed off in the bore 5*b*, for example by decreasing activity of the pumps on the surface, the force of the spring 7 eventually is able to overcome the fluid pressure and force the piston 20 back up the annulus, so that the pin 40 begins to move down the slot 50. Starting from position P2, with the pin 40 in the slot 50 as shown in FIG. 2, the pin 40 tracks down the blind ended axial slot, but does not enter the deviated section of the first track 1*d*', and instead enters a deviated section 2*d* of the second track or return track of the first loop. The second (or return) track of the first loop comprises a first deviated section 2*d* extending anti-clockwise, an axial section and a second deviated section 2*d*' returning in a clockwise direction and converging with the blind ended axial portion corresponding to the first track at P1, where the pin 40 started its journey in FIG. 1. Provided that the piston 20 continues to move upwards so that the pin tracks continuously down the second return track, the pin 40 will cycle back to the starting position at P1, ready for another cycle through the first track. The sub 1 can cycle repeatedly in this manner within the two tracks of the loop, pressuring up and down for any number of desired cycles without activating the tool. This is useful, because it is typically necessary to stop the pumps at the surface from time to time, for example to make up a string connection, to add another stand of pipe, or to remove one. Therefore, with the apparatus according to the present example, the pumps can be activated and deactivated at the surface to add or remove any number of lengths of pipe to the string without affecting the activation or de-activation of the tool controlled by the sub 1, because the pin is simply cycling within the two tracks of the loop, in which both ends of the slot correspond to inactive configurations of the tool.

The first and second tracks described above make up the first loop, and allow the pin 40 to cycle through the first loop as many times as is needed for making up various connections or breaking them at the surface, without activating or de-activating the downhole tool controlled by the sub 1.

Figure 4:
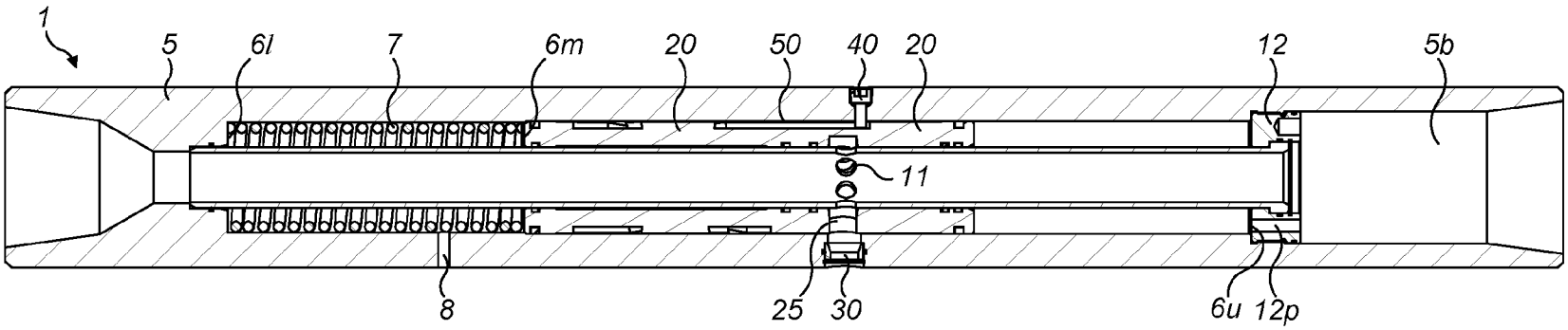
FIG. 4 is a side sectional view of the circulation tool of FIG. 1, in first open configuration, in which the pin is in the second loop and the circulation tool is open.

When the sub 1 is ready to open the circulation ports 30, the pin 40 is cycled though the first track from position P1 to P2 as shown in the transition between FIGS. 1 and 2, and on the return or second track of the first loop, the pin is switched from the first loop to the second loop. This is done on the second track of the first loop, and particularly, in this example, when the pin 40 has emerged from the first deviated part of the second track, and before it has left the second deviated track, to re-enter the first axial track corresponding to the starting position P1. At some point in this transition area P3 between the end of the first deviated portion and the end of the second deviated portion, the direction of movement of the sleeve/piston is reversed by typically switching or adjusting the pumps at the surface, e.g. increasing their level of activity to cause the piston 20 to change axial direction within the annulus. At that point P3, instead of moving down the second track in the transitional area between the end of the first deviated part and the end of the second deviated part, the piston 20 starts to move down in the annulus, and the pin 40 correspondingly moves up the transitional portion of the slot 50. At the top of the axial portion of the second track, the second track branches into a Y-junction, one limb of which branches off to form the first deviated portion of the second track in the first loop, and the other limb (which is typically axially aligned with the axial portion) leads to the second loop. Because of the geometry of the slot, when the pin 40 is moving up the transitional portion, it is tracked into the second loop, and does not return into the deviated part 2*d* of the second track of the first loop. Accordingly, the pin 40 tracks through a deviated section of the second loop to position P4, at the end of a longer axial track corresponding to the position of the sub 1 shown in FIG. 4. The longer axial track at P4 permits longer axial travel of the piston 20 down the annulus until it bottoms out on the middle step 6*m*, which forms a piston stop shoulder and at that point the piston 20 can no longer move axially downwards. At the same point, the pin 40 is located at position P4, and is at or near the very top of the slot as shown in FIG. 4, but the reaction force counteracting the fluid pressure is typically borne by the step 6*m* rather than being completely held by the pin 40 (although it could be). In that position P4, the ports 11, 25 and 30 are axially aligned thereby allowing fluid communication between the inner bore of the flow tube, through the flow tube ports 11, piston ports 25, and through the body ports 30, to the outside of the tool as shown in FIG. 4. Optionally the ports 11 can also be circumferentially aligned with the ports 25 and 30, but this is not essential. This permits fluid to be circulated from the bore 5*b* above the control sub 1 through the ports in order to circulate fluid at high pressures, which is useful for keeping debris in circulation, thereby enabling them to be recovered back to the surface. Circulation continues on this way at high pressure allowing the circulation sub embodying the invention to maintain, for example, drill cuttings and other debris in the annulus between the outside of the body 5 and the inner surface of the wellbore in suspension and helping to wash it back to the surface.

Figure 5:
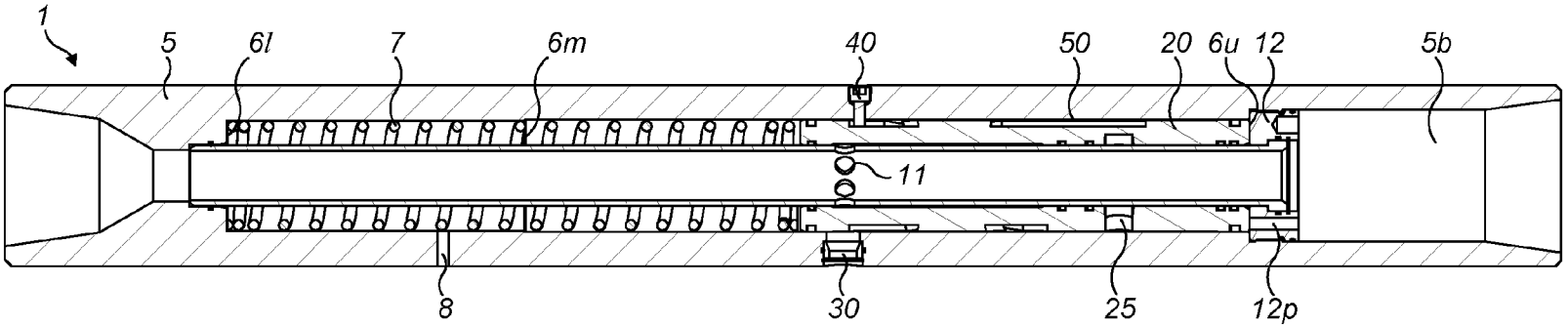
FIG. 5 is a side sectional view similar to FIG. 2, with the circulation tool in the closed configuration, but in which the pin is in the second loop.
Figure 6:
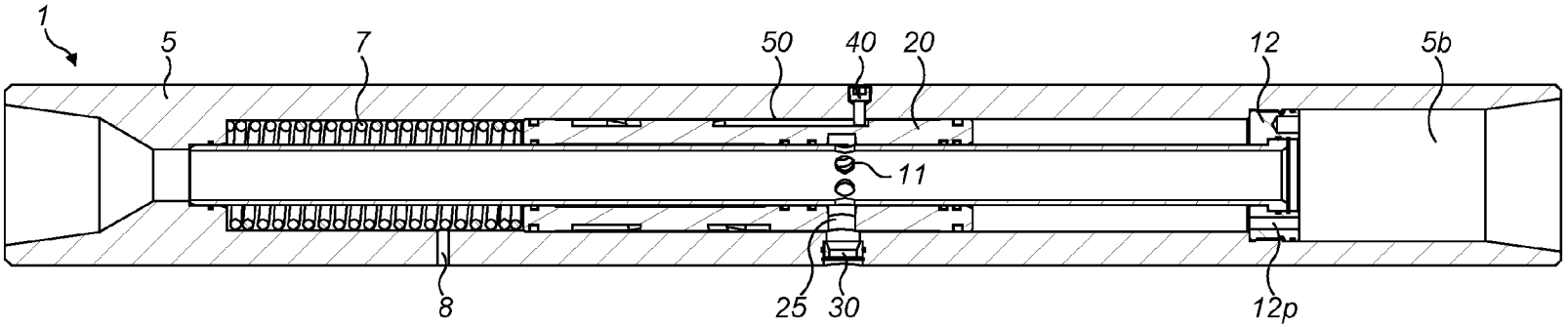
FIG. 6 is a side sectional view similar to FIG. 4, with the circulation tool in an open configuration, but in which the pin is in the second loop.
Figure 7:
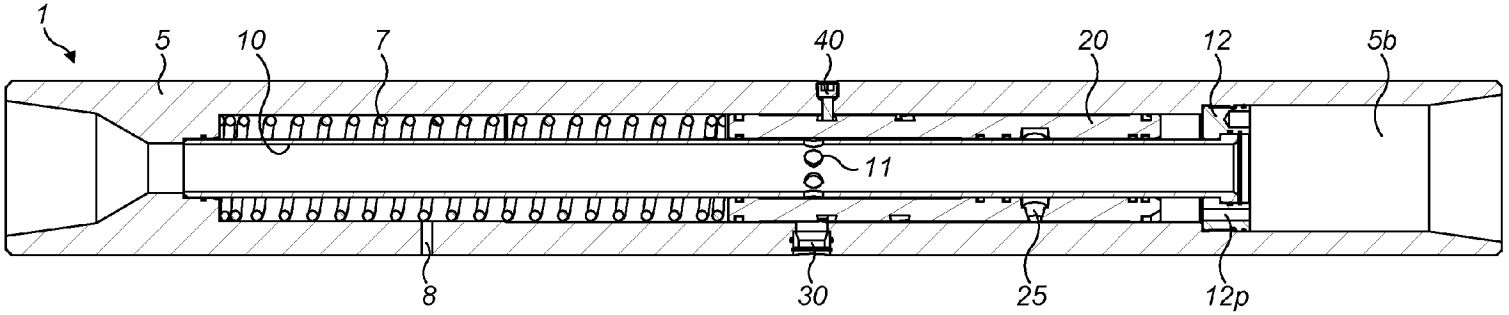
FIG. 7 is a side sectional view similar to FIG. 3, where the pin is about to switch into an adjacent first loop.
Figure 9:
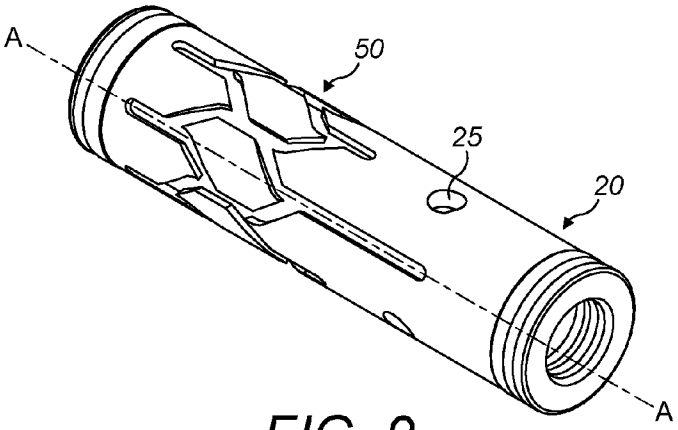
FIG. 9 is a perspective view of the piston of the FIG. 1 apparatus showing the split line A-A.

When circulation operations have been completed, and the circulation is to be ceased, the pumps are switched off (or otherwise adjusted) at the surface, and the force of the spring returns the piston 20 to the FIG. 5 position, by movement of the pin along the second (or return) track of the second loop. The second (or return) track of the second loop is essentially identical in structure and function to the second (or return) track of the first loop, except that the spring returns the piston 20 so that the pin 40 moves to the idling position P5 as shown in FIG. 8 and as shown in FIG. 5, but the longer blind ended axial portion of the slot 50 (visible in FIG. 5 in contrast to the short slot in FIG. 1) allows the tool to switch on circulation as desired by increasing the pressure to move the pin 40 to position P4 as shown in FIG. 8 corresponding to the position shown in FIG. 4, where the pin 40 is at the end of the long axial portion of the slot at P4, and the ports are aligned, allowing circulation of fluid through the wall of the tool. Like the first loop, the second loop allows numerous cycles of inactivation and activation in accordance with the switching on and off of the surface pumps while the pin cycles in the second loop. This pressure increase seen at the bore 5*b* cycles the control sub between sequential active and inactive configurations shown in FIGS. 4 and 5 (corresponding to positions P4 and P5 in FIG. 8) as many times as is desirable, without shifting the tool into any other configuration, and without the pin leaving the second loop until the operator desires. When the circulation operations have been completed, and no more circulation is to be carried out, the pin 40 can be cycled to position P4 corresponding to FIG. 4, before commencing on the return (or second) track of the second loop. As with the first loop, there is a transition zone P6 between the ends of the first and the second deviated sections of the return track, so when the pin 40 reaches the end of the first deviated section of the return track, and before it reaches the end of the second deviated section, the direction of movement of the piston 20 can be reversed by adjusting the pumps from surface, causing the pin 40 to track in the opposite direction at transition zone P6 shown in FIG. 8, moving back in the opposite direction to enter the first track of the next loop, terminating eventually at the end of the short blind ended bore at P2' shown in FIG. 8. The control sub is then effectively back at the P2 position shown in FIG. 2, but has cycled from the first loop, through the second loop and has now entered a subsequent (first) loop, and the pin can track back to the P1' position in that next loop moving the piston back to the position shown in FIG. 1 (but moved around through one cycle) ready to commence further operations starting from the beginning.

FIGS. 10-15 show a further example 101 of the control sub of FIGS. 1-9, with similar parts, which will be referred to with the same reference numbers, but increased by 100, and parts that are shared with the earlier example will not be described in detail here, but the reader is referred to the previous disclosure for an illustration of the structure and function of the corresponding parts of this example. In the second example of FIGS. 10-15, the piston 120, pin 140, slot 50, body 105, spring 107, collar 112, ports 111, 125 and 130 are all typically the same as previously described. The second example differs in the flow tube 110 and the collar 112, which have an optional feature that controls the speed of movement of the pin through the transitional portion, typically allowing more time to switch tracks.

The flow tube has a set of circumferentially arranged small ports 116 arranged in a ring passing through the wall of the flow tube 110 near to the upper end of the flow tube 110. The precise axial distance of the ring of small ports 116 is typically selected in accordance with passage of the pin 140 past the junction between the first and second loops of the slot 50, at the start of the axial section of the second track of the slot 50, as will be explained further below, but this distance can be varied if desired without departing from the scope of the invention. The piston seals above and below the ring of small ports 116 in the FIG. 10 position, and the upper annular seal on the inner face of the piston is close to the upper end of the piston.

The modified collar 112 still has a port 112*p* to admit fluid under pressure from the bore 105*b*, but this is provided with a one way check valve 113, allowing fluid to pass into the annulus from the bore 105*b*, but preventing fluid egress from the annulus back through the valve 113 into the bore 105*b*. Typically three ports 112*p* are provided each having a respective one-way valve 113. The valves typically allow high pressures and high flow rates of fluid in the direction permitted, allowing rapid flooding of the annulus and rapid transmission of pressure to the piston 120, leading to relatively few transmission losses. The collar also has, typically spaced equidistantly between adjacent ports 112*p*, at least one, and optionally more than one bleed valve 114 allowing fluid flow from the annulus back into the bore 105*b*. The bleed valve 114 can optionally be adjustable. The bleed valve typically has a very small bore, or can be adjustable to allow only very small flow rates through the bleed valve 114, typically much less than the port 112*p* and check valve 113. As the piston 120 is sealed in the annulus on its inside and outside surfaces, fluid can only escape from the annulus above the piston through the bleed valve 114. Therefore, the speed at which fluid can escape through the bleed valve determines the speed at which the piston can move back up the annulus after pressure has been reduced. This speed of movement can therefore be adjusted by the setting of the bleed valve.

In operation, the application of pressure to the bore 105*b* drives the piston 120 down the annulus, moving the pin 140 up the slot from position P1 to P2. The device can cycle between settings P1 and P2 as previously described. The annulus floods quickly due to the large bore ports 112*p* and the one way valves 113 do not substantially restrict flooding of the annulus so the piston moves down (and the pin moves up through the first track of the first loop) relatively quickly to the position shown in FIG. 2.

However, the movement of the piston back up the annulus (and the downward movement of the pin back down the second (return) track of the first loop requires the fluid in the annulus above the piston to escape from the annulus before the piston 120 moves up. The fluid in the annulus cannot pass through the check valves 113. When the piston is in the position shown in FIG. 2, and the pin 140 is in the position P2, the fluid in the annulus can escape back to the bore 105*b* via the small ports 116, as well as through the bleed valve 114. The combined flow area of the small ports 116 is relatively large and the initial upward movement of the piston 120 is rapid as the fluid exhausts mainly through the small ports 116. When the uppermost piston seals pass the small ports 116, the pin has just moved past the Y-junction between the first and second loops and is in the transition zone at P3, ready to switch from the first loop into the second loop. At this point the seals on the piston cover the small ports 116 denying fluid passage through the small ports 116, so that the fluid in the annulus can only escape through the small bore bleed valve 114 in the collar 112. The flow rate through the small bore bleed valve is much slower than the flow through the small bores 116 and the ports 112*p*, and the ports 112*p* are closed by the check valves 113, so the piston 120 moves very slowly through the transition zone P3, and the pin therefore remains in the transition zone P3 for a longer period, which can be adjusted by manipulating the pressure differential, and the setting of the bleed valve. The typical settings can allow the pin to remain in the transition zone of the second (return) track at position P3 for e.g. 15 seconds-2 minutes or longer, depending on the characteristics of the bleed valve 114 and the pressure differential. The pumps at surface can be stopped if desired, and changes to the string can be made as previously described, by cycling the pin repeatedly in the inactive first loop.

Switching between the loops typically only takes place when the operator decides. For switching loops, the operator typically increases flow rates, causing the pin to travel to position P2, and the operator then reduces (or cuts off completely) the pressure from surface pumps for approximately 15 seconds-2 minutes to allow the pin to travel to the transition zone P3, and then while the pin is still in the transition zone P3, the operator again increases the flow rate to move the pin to position P4. The annulus floods by wellbore fluid passing through the large bore check valves 113 and ports 112*p* to drive the piston 120 down the annulus (and the pin 140 up the slot 50) to position P4, which can be done quickly as a result of the higher flow areas of the ports 112*p* and check valves 113. Therefore, the second example allows the operator to manipulate the timing of the transition phase with more control. The other operations of this example are similar to the operations previously described for the last example. Any drill string activity while the pumps are switched off typically takes longer than the 15 s-2 minutes transition time for the pin to return through the transition zone P3 to position P1. This allows drill string changes to add or remove stands of pipe to be performed while the pin continues cycling within the two tracks of the first loop. Usually adding a stand of drill pipe to the drill string will take more than 2 minutes.

Figure 16:
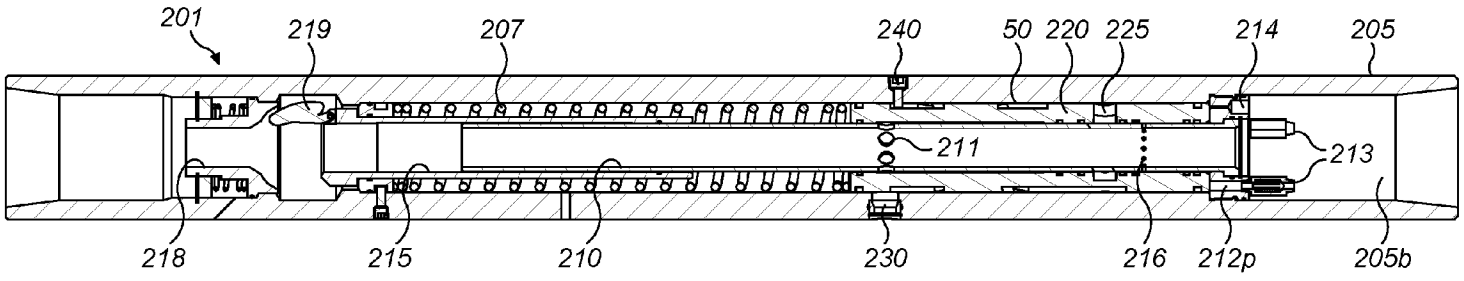
FIG. 16 is a side sectional view of a third circulation tool incorporating apparatus according to the invention, in a first closed configuration in which the pin is in the first loop, the bore pressure is low, and the circulation tool is closed, with the internal passage through the tool being open.
Figure 17:
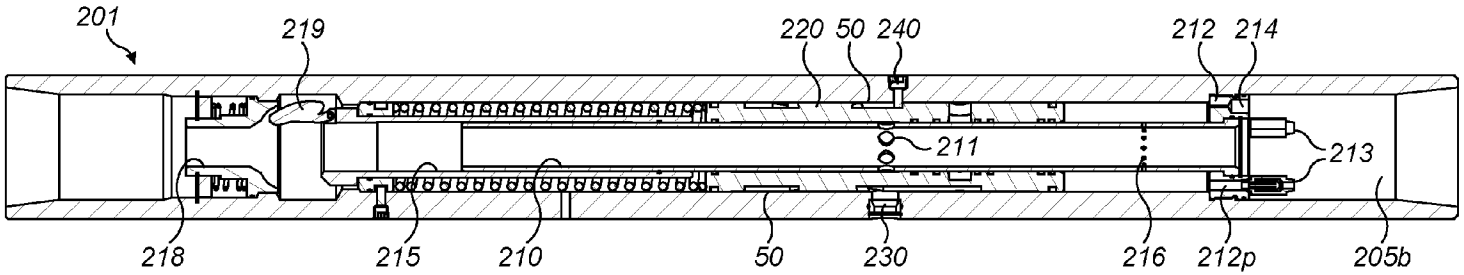
FIG. 17 is a side sectional view of the circulation tool of FIG. 16, in a second closed configuration, in which the pin is still in the first loop, the bore pressure is high, and circulation tool is again closed, with the internal passage through the tool being open.
Figure 18:
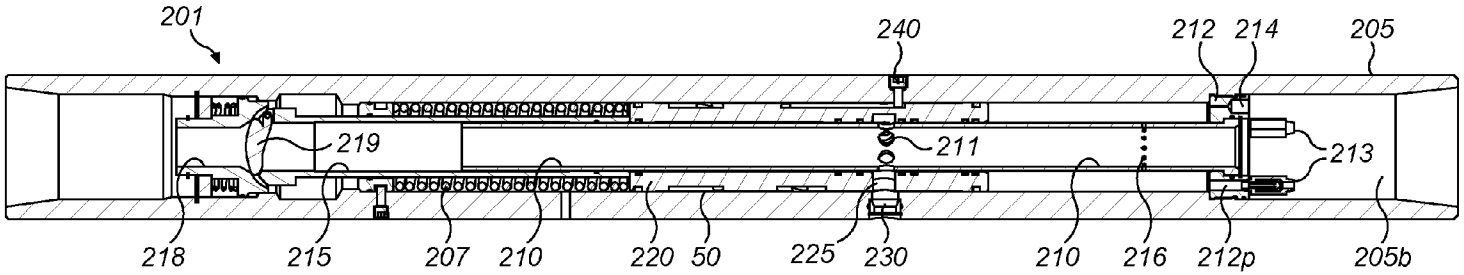
FIG. 18 is a side sectional view of the circulation tool of FIG. 16, in first open configuration, in which the pin has moved into the second loop, the pressure is high, and the circulation tool is open, allowing fluid circulation, and wherein the internal passage through the tool is closed.
Figure 19:
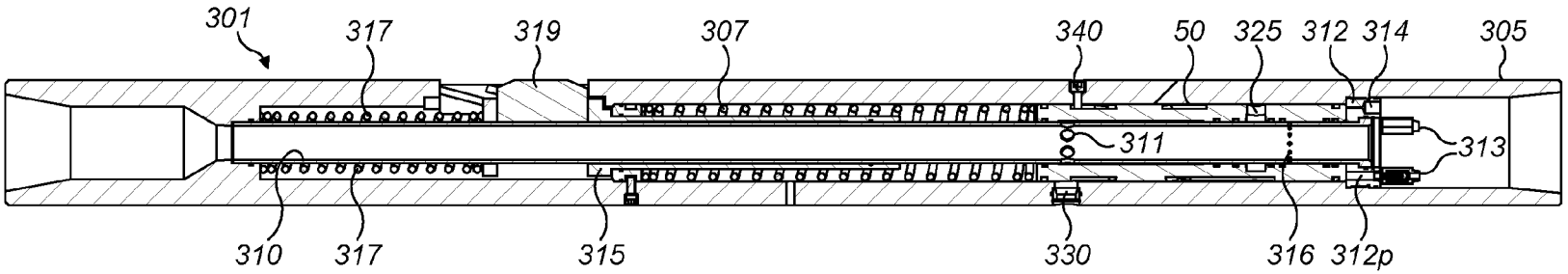
FIG. 19 is a side sectional view of a reaming tool, in a first closed configuration in which the pin is in the first loop, the bore pressure is low, the cutter is retracted and the circulation port is closed.
Figure 20:
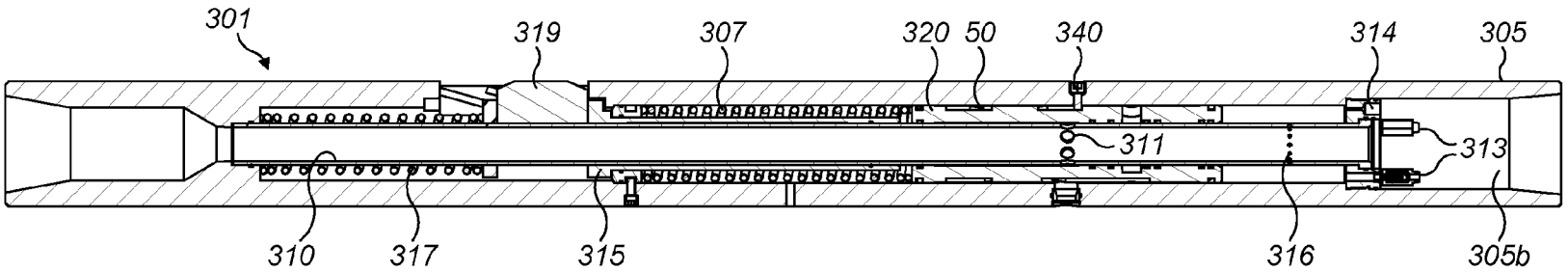
FIG. 20 is a side sectional view of the tool of FIG. 19, in a second closed configuration, in which the pin is still in the first loop, the bore pressure is high, the cutter is retracted and the circulation port is closed.
Figure 21:
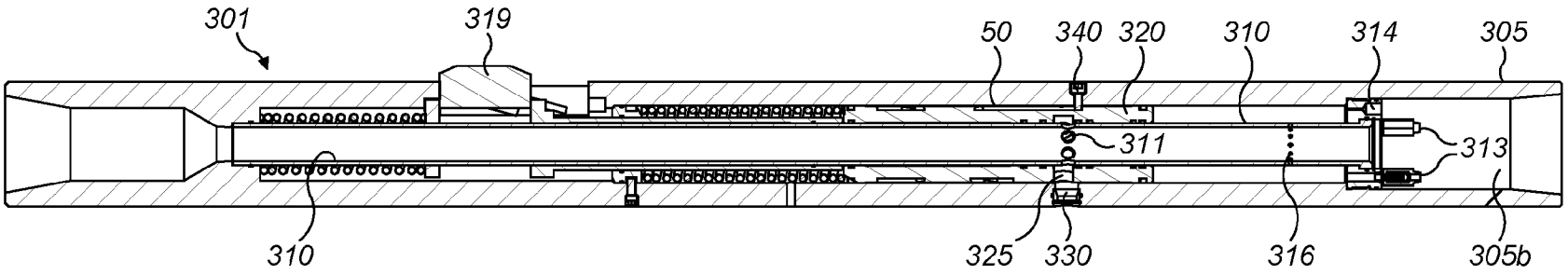
FIG. 21 is a side sectional view of the tool of FIG. 19, in first open configuration, in which the pin is in the second loop, the pressure is high, the cutter is extended, and the circulation port is open.
Figure 22:
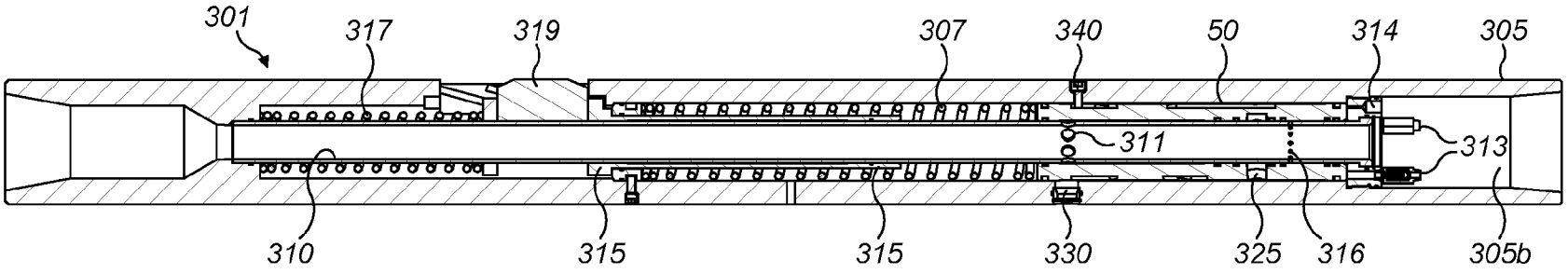
FIG. 22 is a side sectional view of the tool of FIG. 19, with the cutter in the closed configuration at low bore pressure, but in which the pin is in the second loop, the cutter is retracted and the circulation port is closed.
Figure 23:
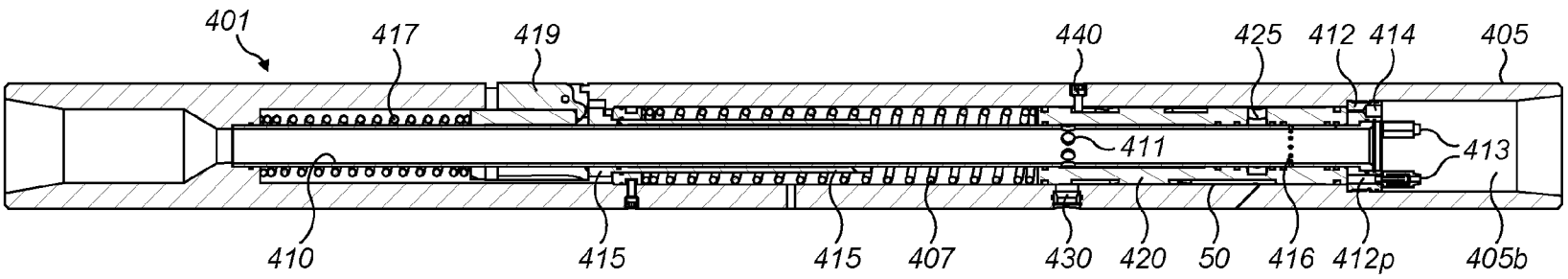
FIG. 23 is a side sectional view of a modified reaming tool, in a first closed configuration in which the pin is in the first loop, the bore pressure is low, the cutter is retracted and the circulation port is closed.
Figure 24:
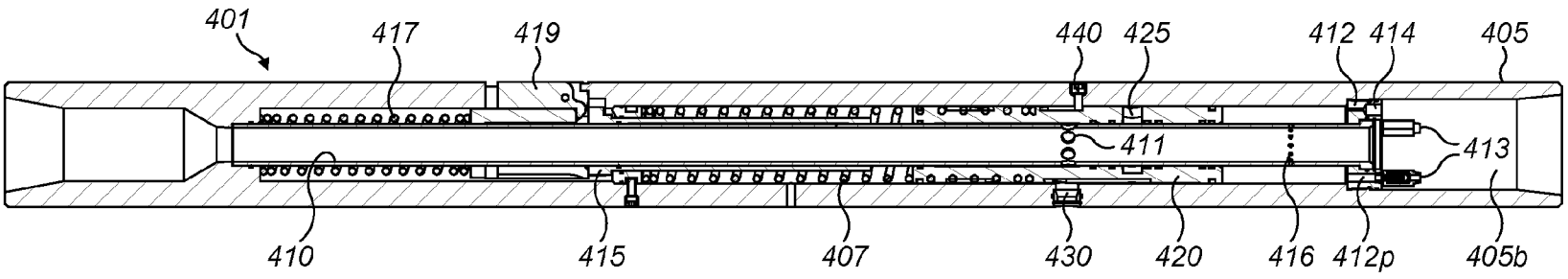
FIG. 24 is a side sectional view of the tool of FIG. 23, in a second closed configuration, in which the pin is still in the first loop, the bore pressure is high, the cutter is retracted and the circulation port is closed.
Figure 25:
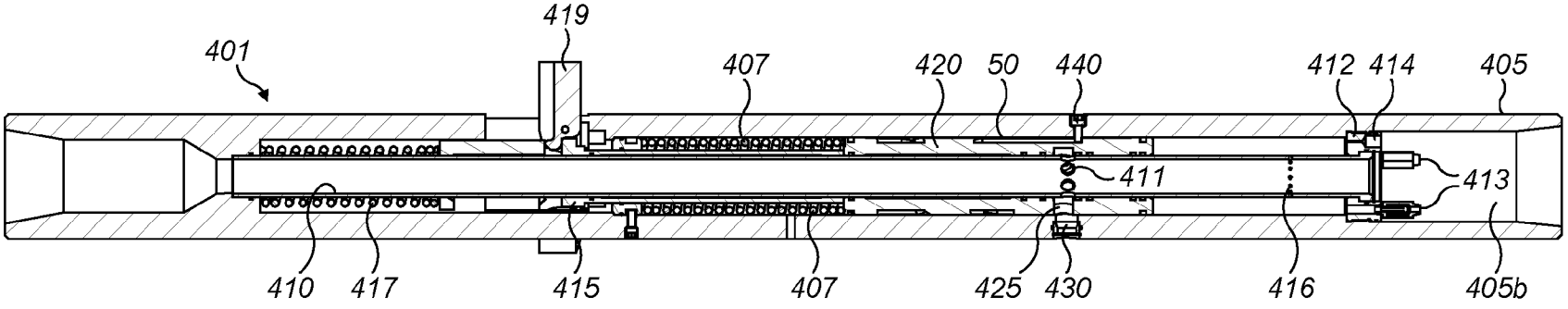
FIG. 25 is a side sectional view of the tool of FIG. 23, in first open configuration, in which the pin is in the second loop, the pressure is high, the cutter is extended and the circulation port is open.
Figure 26:
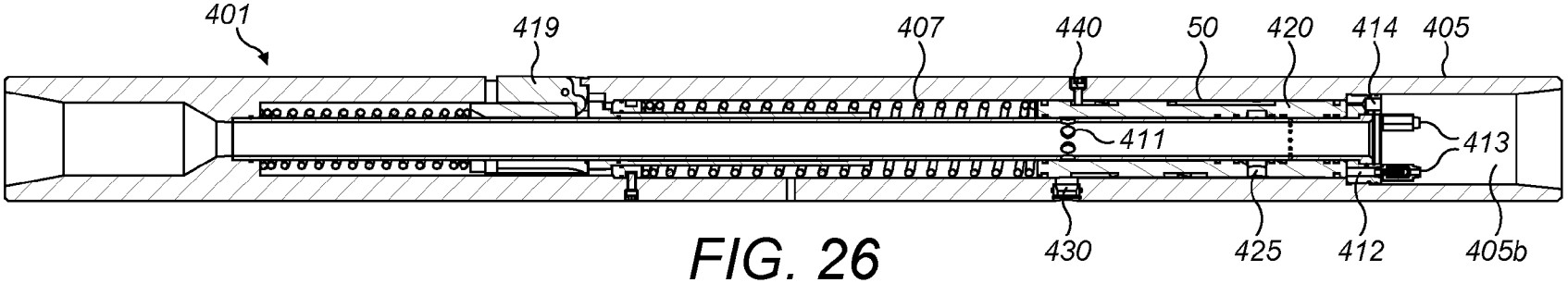
FIG. 26 is a side sectional view of the tool of FIG. 23, with the cutter in the closed configuration at low bore pressure, but in which the pin is in the second loop, with the cutter retracted and the circulation port closed.

FIGS. 16-18 show a modified example 201 of the control sub 101 of FIGS. 10-15, with similar parts, which will be referred to with the same reference numbers, but increased by 100, and parts that are shared with the earlier examples will not be described in detail here, but the reader is referred to the earlier examples for an illustration of the structure and function of the corresponding parts of this example. In the third example of FIGS. 16-18, the piston 220, pin 240, slot 50, body 205, spring 207, collar 212, ports 211, 225 and 230 are all typically the same as previously described.

The flow tube 210 has the same arrangement of small ports 216 with piston seals above and below the ring of small ports 216.

The modified collar 212 has a port 212*p* to admit fluid under pressure from the bore 205*b*, with a one way check valve 213 similar to the valve 113, allowing fluid to pass into the annulus from the bore 205*b*, but preventing fluid egress from the annulus back through the valve 213 into the bore 205*b*. Typically three ports 212*p* are provided each having a respective one-way valve 213. The collar 212 also has, typically spaced equidistantly between adjacent ports 212*p*, at least one, and optionally more than one bleed valve 214 allowing fluid flow from the annulus back into the bore 205*b*. The bleed valve 214 is typically adjustable as previously described for the second example and allows control over the speed at which fluid can escape through the bleed valve and thus the speed at which the piston can move back up the annulus after pressure has been reduced, which can be adjusted by the setting of the bleed valve, as previously described for the last example.

The third example illustrates how certain devices embodying the invention can typically be used to close the bore below the circulation port, and divert more of the fluid through the circulation port. The present example differs from the second example in that the lower end of the spring 207 is stopped by a collet that shoulders on an upwardly facing shoulder surrounding a narrowed throat of the bore 205*b*. The lower end of the flow tube carries a valve tube 215, held against rotation in the bore 205*b* by a guide pin. The valve tube 215 passes through the throat at the shoulder, and on its lower end, the valve tube 215 carries a closure device such as a flap 219 which is typically hinged to one side of the valve tube 215. The upper face of the flap 219 is adapted to seal off the lower end of the valve tube 215, thereby closing the bore through the sub 201. The lower face of the flap 219 is formed to interact with the arcuate upper face of a funnel 218 that gradually curves to guide the closure of the flap around the axis of the hinge as the flap and valve tube move axially down the bore 205*b* of the sub 201. When the valve tube has moved down the bore of the sub 205*b*, the arcuate upper surface of the funnel 218 has guided the closure of the flap 219 over the lower end of the valve tube 215. Accordingly all fluids passing through the upper end of the flow tube 210 are diverted through the ports 225, 230 when they are aligned, and it is thereby possible to create more turbulent circulation conditions in the annulus outside the body 205*b*.

The operation of this example is otherwise similar to the previous version; the application of pressure to the bore 205 drives the piston 220 down the annulus, moving the pin 240 up the slot from position P1 to P2. The device can cycle repeatedly between settings P1 and P2 as previously described, without switching loops until the operator is ready. The annulus floods quickly due to the large bore ports 212*p* and the one way valves 213 do not substantially restrict flooding of the annulus so the piston moves down (and the pin moves up through the first track of the first loop) relatively quickly to the position shown in FIG. 2.

Figure 3:
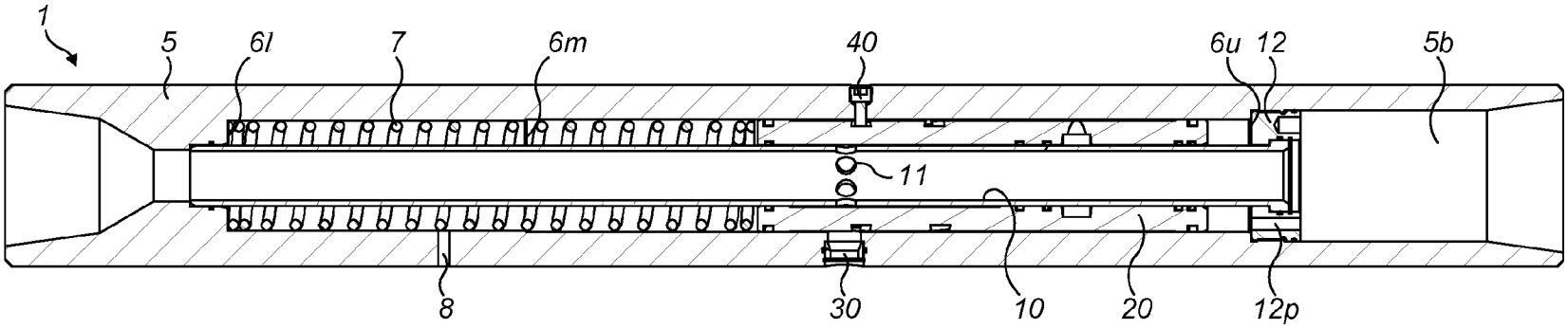
FIG. 3 is a side sectional view of the circulation tool of FIG. 1, in a third transitional configuration, in which the pin is about to transition into the second loop.

The movement of the piston back up the annulus (and the downward movement of the pin back down the second (return) track of the first loop as shown in FIG. 3 requires the fluid in the annulus above the piston to escape from the annulus before the piston 220 moves up. The fluid in the annulus cannot pass back through the check valves 213. When the piston is in the position shown in FIG. 2, and the pin 240 is in the position P2, the fluid in the annulus can pass into the bore 205*b* via the small ports 216. The combined flow area of the small ports is relatively large and the initial upward movement of the piston 220 is rapid as the fluid exhausts through the small ports 216. When the uppermost piston seals pass the small ports 216, the pin has just moved past the Y-junction between the first and second loops and is in the transition zone at P3, ready to transition (if desired) from the first loop into the second loop. At this point the seals on the piston cover the small ports 216 denying fluid passage through the small ports 216, so that the fluid in the annulus can only escape through the small bore bleed valve 214 in the collar 212. The flow rate through the small bore bleed valve is much slower than the flow through the small ports 216 and the ports 212*p*, so the piston 220 moves very slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes (for example) or longer. The pumps at surface can be stopped if desired, and changes to the string can be made as previously described. When the operator decides, the annulus can be flooded once again through the check valves 213 and ports 212*p* to drive the piston 220 down the annulus (and the pin 240 up the slot 50) to position P4, which can be done quickly as a result of the higher flow areas of the ports 212*p* and check valves 213. The flap 219 only engages the funnel 218 when the pin moves into the second loop and into position P4. Therefore, the third example also allows the operator to manipulate the timing of the transition phase with more control, and can apply more of the wellbore pressure to the circulation ports 230 as a result of the closure of the bore 205*b* by the flap 219.

FIGS. 19-22 show a reaming device incorporating a fourth example 301 of a control sub, with similar parts as previously described, which will be referred to with the same reference numbers, but increased by 100, and parts that are shared with earlier examples will not be described in detail here, but the reader is referred to the earlier examples for an illustration of the structure and function of the corresponding parts of this example. In the fourth example of FIGS. 19-22, the piston 320, pin 340, slot 50, body 305, spring 307, collar 312, ports 311, 325 and 330 are all typically the same as previously described. The flow tube 310 has the same arrangement of small ports 316 with piston seals above and below the ring of small ports 316. The modified collar 312 has ports 312*p*, check valves 313, and bleed valves 314 as previously described for previous examples.

The fourth example differs from previous versions in that it in addition to a circulation sub, it comprises a cutting tool which in this example is in the form of an under-reamer. The lower end of the spring 307 is landed on an upwardly facing shoulder of an actuator sleeve 315 pushing a cutter 319 radially outward from the body. When the actuator sleeve 315 moves down the bore of the sub 305*b*, the cutter 319 is moved up a ramp against the force of a retaining spring 317 to extend radially out of the body 305 and initiate cutting operations.

In operation, the application of pressure to the bore 305*b* drives the piston 320 down the annulus, moving the pin 340 up the slot from position P1 to P2. The device can cycle between settings P1 and P2 as previously described. The annulus floods quickly due to the large bore ports 312*p* and the one way valves 313 do not substantially restrict flooding of the annulus so the piston moves down (and the pin moves up through the first track of the first loop to position P2) relatively quickly to the piston position shown in FIG. 20.

The repeated cycling movement of the piston back up the annulus (and the downward movement of the pin back down the second (return) track of the first loop is controlled via the small ports 316 and bleed valve 314 as previously described. When the uppermost piston seals pass the small ports 316, the pin has just moved past the Y-junction between the first and second loops and is in the transition zone at P3, ready to transition from the first loop into the second loop. At this point the seals on the piston cover the small ports 316 denying fluid passage through the small ports 316, so that the fluid in the annulus can only escape through the small bore bleed valve 314 in the collar 312. The flow rate through the small bore bleed valve is much slower than the flow through the small bores 316 and the ports 312*p*, so the piston 320 moves slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes or longer. The pumps at surface can be stopped if desired, and changes to the string can be made as previously described, at a time of the operator's choosing. The annulus can be flooded through the check valves 313 and ports 312*p* to drive the piston 320 down the annulus (and the pin 340 up the slot 50 to position P4) which can be done quickly as a result of the higher flow areas of the ports 312*p* and check valves 313. The sub 305 is then in the configuration shown in FIG. 21, with the reamer cutter 319 extended, and the circulation ports open. The sub 305 can be de-activated as previously described for other examples, recovering the cutter 319 back into the body of the tool under the force of the spring 317 as the piston 320 moves up the annulus. Therefore, the fourth example also allows the operator to manipulate the timing of the transition phase with more control. Other similar examples can be constructed which lack cutters and do not ream, but instead have expandable stabiliser elements, which maintain a predetermined radial clearance between the string and the inner surface of the wellbore.

FIGS. 23-26 show a reaming device incorporating a fifth example 401 of a control sub, with similar parts as previously described, which will be referred to with the same reference numbers, but increased by 100, and parts that are shared with earlier examples will not be described in detail here, but the reader is referred to the earlier examples for an illustration of the structure and function of the corresponding parts of this example. In the example of FIGS. 23-26, the piston 420, pin 440, slot 50, body 405, spring 407, collar 412, ports 411, 425 and 430 are all typically the same as previously described. The flow tube 410 has the same arrangement of small ports 416 with piston seals above and below the ring of small ports 416. The modified collar 412 has ports 412*p*, check valves 413 and bleed valves 414 as previously described for previous examples.

The fifth example differs from the fourth example in that the cutter 419 is hingedly attached to the body and moves radially outward from the body 405 by pivoting around the hinge axis when the actuator sleeve 415 moves down the bore of the sub 405*b*. The cutter 419 is urged by a retaining spring 417 as before, to return it to its starting position when cutting operations have concluded.

In operation, the application of pressure to the bore 405*b* drives the piston 420 down the annulus, moving the pin 440 up the slot from position P1 to P2. The device can cycle repeatedly between settings P1 and P2 as previously described, without switching loops. The annulus floods quickly due to the large bore ports 412 and the one way valves 413 do not substantially restrict flooding of the annulus so the piston moves down (and the pin moves up through the first track of the first loop to position P2) relatively quickly to the piston position shown in FIG. 24.

The movement of the piston back up the annulus (and the downward movement of the pin back down the second (return) track of the first loop is controlled via the small ports 416 and bleed valve 414 as previously described. When the uppermost piston seals pass the small ports 416, the pin has just moved past the Y-junction between the first and second loops and is in the transition zone at P3, ready to transition from the first loop into the second loop. At this point the seals on the piston cover the small ports 416 denying fluid passage through the small ports 416, so that the fluid in the annulus can only escape through the small bore bleed valve 414 in the collar 412. The flow rate through the small bore bleed valve is much slower than the flow through the small bores 416 and the ports 412*p*, so the piston 420 moves slowly, and the pin remains in the transition zone P3 for a longer period, which can be adjusted by manipulating the pressure differential, and the setting of the bleed valve. The typical settings can allow the pin to remain in the transition zone of the second (return) track at position P3 for 15 seconds-2 minutes or longer. The pumps at surface can be stopped if desired, and changes to the string can be made as previously described. The annulus can be flooded through the check valves 413 and ports 412*p* to drive the piston 420 down the annulus (and the pin 440 up the slot 50 to position P4) which can be done quickly as a result of the higher flow areas of the ports 412*p* and check valves 413. The sub 405 is then in the configuration shown in FIG. 25, with the reamer cutter 419 extended, and the circulation ports open. The sub 405 can be de-activated as previously described for other examples, recovering the cutter 419 back into the body of the tool under the force of the spring 417 as the piston 420 moves up the annulus.

Figure 27:
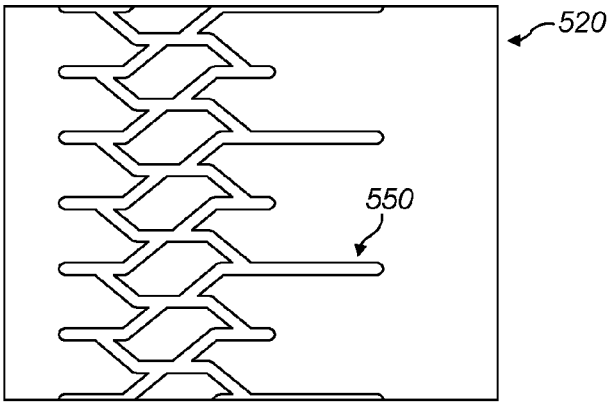
FIGS. 27-29 show three views of pistons similar to FIG. 8, showing alternative variants of slot used in different designs of pistons, usable in the FIG. 1 device.

Referring now to FIG. 27, an alternate design of piston 520 is shown in flat view similar to FIG. 8. The alternate design of piston 520 has a slot 550 which is effectively the mirror image of the slot 50 shown in FIG. 8, and which typically works in the same way as the piston 20 having the slot 50 as shown in FIG. 8, except that the pistons 20 and 520 rotate in opposite directions. Other functions of the piston 520 are the same as previously described for other examples. The piston 520 typically incorporates a separate sleeve that is provided with ports (not shown) similar to ports 25 provided in piston 20. Typically the piston 520 does not have any integral ports as a result.

Figure 28:
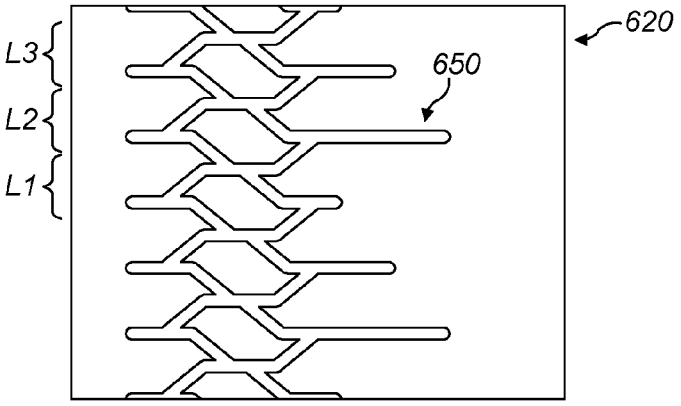

Referring now to FIG. 28, this shows a similar view to FIG. 27 with an alternate design of piston 620 having a different profile of slot 650. The slot 650 has first, second and third loops L1, L2 and L3 which are similar in design to the individual first and second loops of the piston 20 and which function in the same way. The difference in the sleeve 620 is that each of the loops L1, L2, and L3 allow different maximum lengths of axial travel in their uppermost axial portions. Therefore, the pin travels different axial distances depending on which loop it is located in, which allows the piston 620 to select different configurations of the tool that it is controlling according to the switching of the pin between the loops. For example, the first loop L1 can cycle between two inactive positions. The second loop L2 can cycle between inactive and partially active (e.g. 50% active) configurations of the tool. The third loop can cycle between inactive and fully active configurations of the tool, or some other level of activity (e.g. 70 or 80% active). Switching of the pin between the different loops L1, L2 and L3 is performed as previously described for earlier examples.

Although the pin is allowed to travel in increasingly large ranges of axial movement through the different loops L1, L2 and L3, this does not necessarily correspond to increasing levels of activation possible in the tool being controlled, and for example, L3 might allow a lower level of activation than L1 or L2.

In a possible second example of operation of the FIG. 28 arrangement used for controlling a reamer, the first loop could be used to cycle the reamer between inactive positions. The second loop tool could be configured to activate the cutter arms, and the third loop could be configured to open the cutter arms as per loop 2 but for a larger radial displacement In another possible application of the FIG. 28 arrangement, it could be used to control a combined reamer and circulation sub, in which the 1st loop could be arranged to cycle the tool between different inactive configurations, the 2nd loop could be configured to activate the reamer only, or the circulation sub only; and the 3rd loop could be configured to activate both the reamer and the circulation sub.

The slot 650 can be arranged to cycle through the sequence of loops L1, L2, L3 in either direction, in accordance with the opposing directions of the slots 550 and 50, as previously described. More than 3 loops can be provided.

Figure 29:
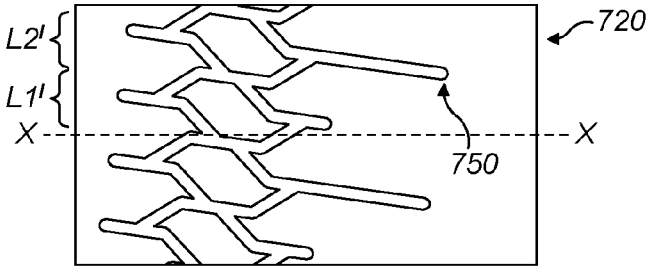

Referring now to FIG. 29, a further alternative design of piston 720 is disclosed having another variation of slot 750. The slot 750 has two loops L1' and L2' (although it could have more than two loops as described for slot 650). In the slot 750, the linear portions at the blind ends of the loops L1' and L2' are non-parallel to the axis X-X of the piston 720, so that the whole of the slot 750 is deviated at an angle with respect to the axis X-X. Therefore, travel of the pin in the slot 750 causes continual rotation of the piston, and the extent of rotation varies in accordance with the angle of deviation away from the axis X at each part of the slot 750. The linear blind ended portions of the slot 750 in each of the loops L1' and L2' are typically parallel to one another, although this is not necessary.

Optionally the slot 750 can be arranged to cycle through the sequence of loops in either direction, in accordance with the opposing directions of the slots 550 and 50, as previously described. More than 2 loops can be provided in the slot 750.

In a typical example, apparatus according to the invention that is incorporated into a control sub in a circulating string typically according to the first example can be operated as follows:

1. Prepare to run tool string into the hole, pumps at surface can be idle, pumping 0 GPM/0 PSI. Pin is typically held in position P1.
2. Run tools into the predrilled hole, while operating surface pumps at around 100 GPM, which typically corresponds to around 24 PSI at bit. Pin moves to position P2.
3. Add subsequent sets of drill pipe at surface, while pumps idle pumping 0 GPM/0 PSI at bit. Pin moves from position P2 back to position P1 (passing through transition zone P3). Adding a set of drill pipe to the string can take approximately 2-5 minutes.
4. Continue steps 2 and 3 until tool string reaches required depth.
5. Drill with higher pressure from pumps at surface, typically around 300+GPM, corresponding to around 225 PSI at bit. Travel pin is moved into position P2, with circulation valve closed.
6. Add another set of drill pipe at surface, while pumps are idle, at 0 GPM, 0 PSI at bit. Travel pin moves from position P2 back to position P1 (passing transition zone 3) again adding set of drill pipe.
7. Continue steps 5 and 6 until required to activate presented tool e.g. circulation sub, under-reamer, stabiliser etc.
8. To activate tool by switching between first and second loops, increase flow rate at surface pumps to 100+GPM, moving the pin into position P2, corresponding to around 24+PSI at the bit, then reduce the flow rate to less than 60 GPM at surface, or around 9 PSI at the bit, or shut down surface pumps completely for approximately 20-50 seconds. Pin moves to transition zone (position P3). While the travel pin is crossing transition zone P3 start pumps again with 100+GPM, 24+PSI at the bit. This causes the pin to switch between loops and move to position P4. In this position, the pin has entered the second loop, allowing entry to the long travel slot and accordingly the tool is activated. The circulation sub typically increases TFA, the under-reamer can typically extend the cutter face, and/or the stabiliser can typically extend stabilising pads.

9. If tool is required to stay in the ON position, continue drilling as per steps 5 & 6 until required to deactivate presented tool. Pin will travel between position P4 and P5 corresponding to the flow. If there is a small mount of pressure on the piston, the travel pin will move to position P4. If there is no pressure on the piston, the travel pin will return to position P5 (passing through the transition zone P6).

10. To switch OFF the tool the same method is followed as per step 8. This time when pressure reduces, pin moves from position P4 to transition zone P6 and after increasing flow in the system the pin will move to position P2' which corresponds to position P2 above.

11. Tool can be activated and deactivated as many times as required using the method described in steps 8 and 10.

As mentioned in step 8, in order to activate the tool the pumps can be switched off for 20-50 seconds, but this can be adjusted for different periods of time. Also 60 GPM with 9 PSI can be adjusted if required. Pump rates and pressure values can be varied within the scope of the invention.

Embodiments permit the construction of tools that switch between high and low pressure (or on and off) where the pressure can be reduced (optionally to zero) for a particular time, after which the pressure can be increased or applied again with the tool in the active configuration. Other embodiments allow switching between high and low pressure where the pressure is reduced to a particular value that allows switching between the in-active (first) and active (second) loops.

The invention also provides a control slot for a pin and slot arrangement for a downhole controller, wherein the slot comprises a first loop and a second loop, the first loop being configured to cycle the tool between different inactive configurations, and the second loop being configured to cycle the tool between inactive and active configurations.

Thus embodiments of the slot provide loops in both ON and OFF configurations, and permit switching between the loops.

Radial spacing of the P1, P2 and other positions in the profile can typically be varied within the scope of the invention. One profile might have positions P1 and P2 that are spaced circumferentially from positions P5 and P4 by e.g. 180 degrees, but other examples might have different spacing and/or more or less pairs of loops. For example, there might be three pairs of loops with equivalent positions spaced 60 degrees around the circumference of the piston. There might be a different numbers of profiles spaced with different angles.

In the examples disclosed, the positions P1 and P2 are typically functionally equivalent to positions P5 and P4, but these pairs of loops do not need to have structural equivalence, and P1 and P2, for example, do not need to be in axial alignment with one another as shown in the examples. Position P1 can optionally be displaced around the circumference with respect to position P2, which will change the shape of the profile but need not change functionality of the tool.

FIGS. 30-33 show a modified example of the control sub of FIGS. 16-18, with similar parts, which will be referred to with the same reference numbers, but starting with "8" instead of "2", and parts that are shared with the earlier examples will not be described in detail here, but the reader is referred to the earlier examples for an illustration of the structure and function of the corresponding parts of this example. In the present example of FIGS. 30-33, the piston 820, pin 840, spring 807, collar 812, small ports 816, port 812*p*, one way check valves 813, and bleed valve 814 are all typically the same as previously described, although in some versions, the slot 850 can typically have each loop formed with long slots at the upper end, instead of alternating short and long slots as shown in the drawings.

The body 805 is divided into a valve sub 805*v* secured by a pin and box arrangement below a piston sub 805*p*. The valve sub 805*v* carries a closure member in the form of a flap 819 that closes the bore 805*b* in a similar manner to the flap 219. The flap 819 is secured to the end of a valve tube 815, and moves with the valve tube 815. The valve tube 815 is mounted on the lower end of a valve piston 816, which is co-axially mounted on the outer surface of the flow tube 810, and can slide relative to the flow tube 810, which is fixed to the body, typically by means of the collar 812. Optionally the collar 812 can comprise an upper collar 812*u* and a lower collar 812*l*, spaced along the flow tube, and typically immovably connected to the body e.g. by welding, screw attachment, etc. The collars 812*u,l* typically centre the flow tube 810 in the bore 805*b* as well as fixed it axially to the body. The lower collar 812*l* typically acts as an end stop for the spring 807, which is compressed between the lower collar 812*l* and the lower end of the piston 810.

The ports 830 through the body are typically spaced away from the piston 850, and in this embodiment are provided on the valve sub 805*v*. The valve piston 816 typically carries the ports 825, and the ports 811 on the flow tube are also carried in the valve sub 805*v*. The valve piston 816 slides axially over the flow tube 810 to expose and cover the ports 811 and allow and deny communication through the ports 830. The valve piston 816 has a piston area having different sealed diameters so that when subjected to a pressure differential it moves down the bore 805*b* towards the flap 819. Also, the valve piston is pushed in the same direction by a very thin valve actuator sleeve 817 (best seen in FIG. 30*b*) which overlies the flow tube 810 and can slide down to push the upper end of the valve tube 816.

The present example also contains an optional mechanism to limit the travel of the spring when the piston has moved down the annulus, so that the pin essentially functions as a rotation controller, and bears less axial load when it approaches the ends of the slots, allowing the present example to be used in high pressure scenarios without overloading the pin.

The travel limiting mechanism comprises a pair of intercalating upper and lower sleeves 860*u* and 860*l* mounted on the piston 850 and the lower collar 812*l* respectively, which have opposed intercalating formations permit different extents of axial travel dependent on the relative rotations positions of the formations 860*u,l*. In the present example, the intercalating formations are provided by generally parallel sided fingers 861*u* and 861*l*, although the precise shape can vary in different embodiments. Because the lower sleeve 860*l* is fixed to the lower collar, which is fixed to the body, the lower fingers 861*l* do not rotate and do not translate axially. However, the upper sleeve 860*u* is fixed to the axially movable and rotatable piston 850, and so rotates and translates with the piston 850, relative to the static lower sleeve.

Figure 31B:
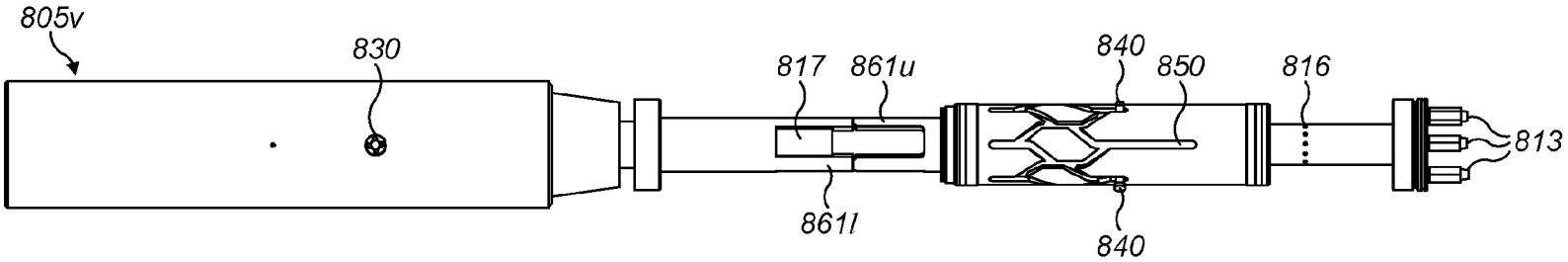
Figure 32B:
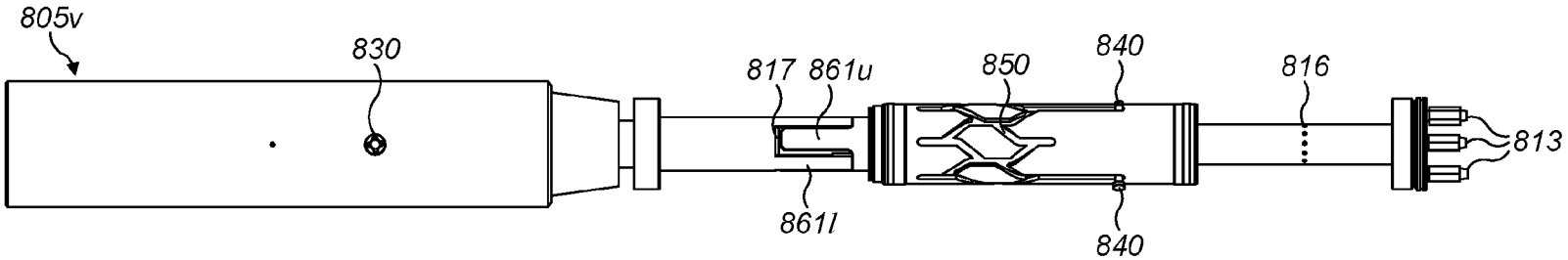
Figure 33B:
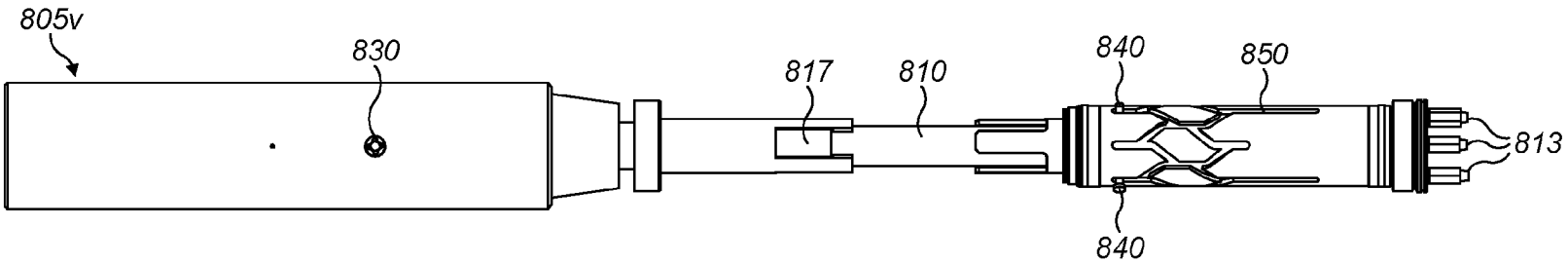

Thus the upper fingers can be circumferentially aligned with the lower fingers and spaced apart therefrom as shown in FIG. 30*b*, or circumferentially aligned and abutted against the lower fingers as shown in FIG. 31*b*, such that the ends of the fingers limit further axial travel, or circumferentially staggered and intercalated as shown in FIG. 32*b*, in which the maximum axial travel of the sleeves 860 has been achieved, or circumferentially staggered and axially spaced apart as shown in FIG. 33*b*. In the two middle positions, the maximum axial travel of the piston therefore depends on the relative rotational positions of the fingers 861 on the two sleeves. The relative rotational positions of the fingers when the sleeves 860 are spaced apart is not always significant; it is the abutment or intercalating of the fingers when the sleeves are pressed together that is typically important as it is this that allows or denies the additional axial travel that activates the device.

The operation of this example is otherwise similar to the FIG. 16 version; the application of pressure to the bore drives the piston 820 down the annulus, moving the pin 840 up the slot corresponding to previously described positions P1 and P2. The device can cycle repeatedly between settings P1 and P2 as previously described, without switching loops until the operator is ready. The annulus floods quickly due to the large bore ports 812*p* and the one way valves 813 do not substantially restrict flooding of the annulus so the piston moves down (and the pin moves up through the first track of the first loop) relatively quickly to the position shown in FIG. 31. At this stage the fingers 861*u,l* are aligned and abut one another, which limits the extent of axial travel of the piston 820, typically before the pin 840 has reached the end of the short slot. This relieves the forces acting on the pin 840.

Optionally the piston can be formed with all upper slots having the same dimensions, and the limit of travel within the slot can be defined by the sleeves 860 alone.

The movement of the piston 820 back up the annulus (and the downward movement of the pin back down the second (return) track of the first loop requires the fluid in the annulus above the piston to escape from the annulus before the piston 820 moves up. The fluid in the annulus cannot pass back through the check valves 813, and as before, the fluid in the annulus is routed into the bore 805*b* via the small ports 816. The combined flow area of the small ports is relatively large and the initial upward movement of the piston 820 is rapid as the fluid exhausts through the small ports 816. When the uppermost piston seals pass the small ports 816, the pin has just moved past the Y-junction between the first and second loops and is in the transition zone, ready to transition (if desired) from the first loop into the second loop. At this point the seals on the piston cover the small ports 816 denying fluid passage through the small ports 816, so that the fluid in the annulus can only escape through the small bore bleed valve 814 in the collar 812. The flow rate through the small bore bleed valve is much slower than the flow through the small ports 816 and the ports 812*p*, so the piston 820 moves very slowly, and the pin remains in the transition zone for a longer period, which can be adjusted by manipulating the pressure differential, and the setting of the bleed valve. The typical settings can allow the pin to remain in the transition zone of the second (return) track for 15 seconds-2 minutes (for example) or longer. The pumps at surface can be stopped if desired, and changes to the string can be made as previously described. While the pin 840 is cycling in the first (inactive) loop, the fingers are aligned as shown in FIGS. 30 and 31, and so the upper fingers 861*u* are always spaced from the valve actuator sleeve 817, so the valve is never actuated.

When the operator decides to switch tracks and activate the device, when the pin is in the transition zone, the annulus can be flooded once again through the check valves 813 and ports 812*p* to drive the piston 820 down the annulus (and the pin 840 up the slot 850) to the position shown in FIG. 32*b*, which is equivalent to position P4, which can be done quickly as a result of the higher flow areas of the ports 812*p* and check valves 813. Note that as a result of the rotation of the piston 820, the fingers 861*u* on the upper sleeve 860*u* are no longer aligned with the fingers 861*l* on the lower sleeve 860*l*, and so the two sets of fingers 861 can intercalate, allowing the upper pins 861*u* to engage the thin valve actuator sleeve 817, and push it down to the position shown in FIG. 32*b*. This slides the whole valve piston 816 and valve tube 815 down towards the flap 819, which compresses a spring urging the valve piston 816 up the bore towards the piston 820.

Thus, in the active position when pressure is applied, piston 820 moves the attached upper sleeve 860*u* down the outer surface of the flow tube. When the intercalating fingers on the upper sleeve slide in between the fingers on the lower sleeve 860*l*, they engage the upper end of the thin valve actuator sleeve 817 (underlying the lower sleeve 860*l*). The valve actuator sleeve is attached to the valve piston 816, and as it is pushed down the flow tube, this pushes the valve piston down the outer surface of the flow tube until a seal on the inner surface of the valve piston passes below the ports 811 on the flow tube, which admits the high fluid pressure pumped from the surface through the bore of the flow tube through the ports 811 and behind the sealed area of the valve piston 816. The outer surface of the valve piston 816 is also sealed against the inner surface of the valve sub 805*v*, and the opening of the ports 811 through the flow tube creates a differential across the different diameters of sealed inner and outer areas of the valve piston 816, which is thereby urged down the bore 805*b* against the force of a spring which is held in compression between a step on the valve piston 816 and a collar that is fixed to the valve body 805*v*. Under the force generated by the pressure differential the valve piston 816 moves down relative to and independently from the upper control piston 820, and has a stroke that is not limited to the stroke of the piston 820. When the force generated by the pressure differential reduces below the force of the compressed spring, the spring force returns the valve piston 816 to the initial position, with the ports 811 sealed. Optionally the upper control piston 820 could stop moving in the bore, and the valve piston 816 could travel alone to close the flap and align ports 830 and 825, although in some embodiments, both pistons will typically travel together providing more force to close the flap. The annulus (which is typically sealed) below the sealed area of the valve piston 816 is typically at ambient pressure, and typically has a small port through the wall of the valve sub 816 to connect the annular area to the exterior of the tool, which reduces the risk of hydraulic locking of the valve piston. When there is no pressure in the system, the valve piston 816 is typically in the closed position shown in FIG. 33*a*, with the spring expanded between the collar and the step on the valve piston 816, driving the valve piston 816 against an inner shoulder on the pin at the top of the valve sub 805*v* which acts as a piston stop.

Once the valve piston 816 has moved down enough to align the ports 825 on the valve piston 816 and the ports 811 on the flow tube, the force from the fluid pressure in the bore 805*b* is then transferred to the valve piston 816, and it is urged downwards in the valve sub 805*v* by the large force of the hydraulic pressure. Hence the initial motive force transferred by the actuator sleeve 817 to allow the fluid pressure to bear on the valve piston 816 can be relatively small and the associated components can be lighter and less complex. Also, the forces closing the valve can thereby be arranged to act directly on the valve piston allowing efficient force transfer and high closure forces. Typically a small port through the wall of the valve sub into the piston area reduces the risk of hydraulic locking of the valve piston 816.

The jetting ports 830 permit re-circulation of fluid from the bore 805*b* at high pressures, while the bore is closed below by means of the flap, thereby directing all of the bore fluid through the jetting ports. Spacing the jetting ports from the piston 820 means that the slot 850 can be sealed off from the high pressure fluids passing through the bore 805*b* and out of the jetting ports 830, and so there is less risk of debris entering the slot and restricting movement of the piston.

When the circulation operations are finished, the pumps are switched off at surface, and the valve piston 816 returns to the closed position shown in FIG. 30, under the force of a spring.

As before, the flap 819 only engages the funnel 818 when the pin moves into the second loop and into position P4. Therefore, this example also allows the operator to manipulate the timing of the transition phase with more control, and can apply more of the wellbore pressure to the circulation ports 830 as a result of the closure of the bore 805*b* by the flap 819. Also, the piston 820 and slot 850 can be engineered to a lower level as their function can be focussed on controlling the operation rather than providing the motive force for operating the tool, but the device as a whole can be used in higher pressure applications as the high force aspects can be engineered into the valve piston which can be separated from the control piston 820.

The present arrangement also allows less engineering focus on the slot, which can typically have both first and second loops having physically identical shapes, but the behaviour of the pin in the different loops can be governed by other factors such as the intercalating fingers below the piston.

It should be noted that the present example can operate tools other than valves (e.g. cutters, under-reamers etc. as shown in other examples herein), and different kinds of valves other than flap valves as shown, and the present embodiments are shown for example only.

One advantage of certain embodiments over J-slot and dropped ball alternative, is that the device can be reversibly activated and de-activated within a short period of time, e.g. within 1 minute. The device can be arranged to cycle between inactive configurations, without changing the cycle until the unique procedure of changing loops is initiated by choice of the operator. Therefore, when the operator stops the surface pumps to add another set of drill pipe, the device will typically stay in same (typically inactive) loop. When the operator increases the flow rate again, the device will typically cycle back within the same loop, without changing the configuration of the device being controlled.

The invention claimed is:

1. Apparatus for controlling a downhole device in an oil, gas or water well, the apparatus comprising a body having a control slot engaging a pin, the control slot and the pin being provided on separate parts that are movable relative to one another, such that movement of the pin relative to the control slot switches the downhole device between active and inactive states, the slot having at least one first loop wherein the pin is moveable between different idling configurations of the pin and slot in which the device is inactive, and at least one second separate loop spaced around the body with respect to the first loop, and wherein the pin is moveable in the second loop between different configurations of the pin and slot which correspond to active and inactive configurations of the downhole device, wherein the pin is switchable between the first and second loops, and wherein the pin is cycleable between the different configurations within each one of the at least one first loop and the at least one second loop without switching between the first and second loops, wherein each loop comprises a first track and a second track, and the second track returns the pin to the starting point of the first track, wherein the at least one first loop has a first axial track at one end, and the at least one second loop has a second axial track at the same end, with a length different from that of the first axial track, wherein the slot has alternating first and second loops spaced circumferentially around the body, and wherein each of the alternating first loops overlap adjacent alternating second loops at a transition area.

2. Apparatus as claimed in claim 1, wherein the pin is cycleable repeatedly between the two different configurations of the pin and slot until switched between the loops.

3. Apparatus as claimed in claim 1, wherein the body has an axis, and wherein the pin moves in opposite directions in the two tracks with respect to the axis of the body.

4. Apparatus as claimed in claim 3, wherein the pin is switchable between the first and second loops on the second track.

5. Apparatus as claimed in claim 4, wherein the pin is switched between loops by reversing the relative axial direction of movement of the pin and slot.

6. Apparatus as claimed in claim 5, wherein at least one of the loops has a transition portion adapted to switch the pin between the loops in the transition portion, wherein the transition portion is provided in the second track of the loop, and incorporates a junction leading to the next loop.

7. Apparatus as claimed in claim 6, wherein the junction is a Y-junction, and the switching between loops is accomplished by reversing the direction of movement of the pin relative to the slot when the pin is in the combined trunk of the y, heading away from the junction between the connecting upper limbs of the y, and wherein the two limbs of the y junction comprise parts of different respective loops.

8. Apparatus as claimed in claim 7, wherein the first and second tracks have linear portions and deviated portions and wherein the deviated portions drive relative rotation of the pin and slot with a greater rotational component than the linear portions.

9. Apparatus as claimed in claim 8, wherein both the linear and deviated portions drive relative rotation of the pin and slot.

10. Apparatus as claimed in claim 9, wherein the speed of movement of the pin in the first track is different from the speed of the pin in the second track.

11. Apparatus as claimed in claim 10, wherein the pin moves more slowly in the second track of the slot than in the first track.

12. Apparatus as claimed in claim 11, wherein the difference in speed between the first and second track is controlled by hydraulic means.

13. Apparatus as claimed in claim 12, comprising a piston responsive to pressure changes in the well, and axially movable in a bore in the apparatus in response to said pressure changes, and wherein the axial movement of the piston in the bore drives the relative movement of the pin and the slot.

14. Apparatus as claimed in claim 13, wherein the slot is provided on the piston.

15. Apparatus as claimed in claim 1, having more than two loops, and wherein the pin is cycleable from first to second to third or subsequent further loops before returning to the first loop and repeating the cycle.

16. Apparatus as claimed in claim 15, wherein different loops allow the pin to travel to different configurations of the pin and slot that switch the device between different states.

17. Apparatus as claimed in claim 16, comprising first and second pistons, wherein the first piston carries the control slot, and the second piston is movable in the body relative to the first piston in response to fluid pressure to drive the operation of the downhole device.

18. Apparatus as claimed in claim 17, incorporating a stop mechanism to restrict axial movement of the pin within the slot, wherein the stop mechanism restricts relative axial movement of the pin and slot in a first configuration, and allows greater relative axial movement of the pin and slot in a second configuration of the pin and slot, and wherein the axial movement of the pin in the slot is restricted before the pin reaches the end of the slot.

19. Apparatus as claimed in claim 18, wherein the first and second configurations of the pin and slot correspond to different rotational orientations of the pin and the slot.

20. Apparatus as claimed in claim 19, wherein the downhole device comprises a valve, a cutting tool, or a stabiliser.

21. An apparatus as claimed in claim 1, wherein activation and inactivation is in accordance with the switching on and off of the surface pumps while the pin cycles in the second loop.

22. A method of controlling a downhole device in an oil, gas or water well, the method comprising providing an apparatus comprising a body having a control slot and a pin on separate relatively movable components so that the slot engages the pin and the pin and slot are movable relative to one another, wherein the slot having at least one first loop and at least one second loop; and moving the pin relative to the slot to switch the downhole device between active and inactive states, wherein each of the at least one first loop has a first axial track at one end, and each of the at least one second loop has a second axial track at the same end, with a different length from that of the first axial track, wherein each loop comprises a first track and a second track, wherein the second track returns the pin to the starting point of the first track, and the slot has alternating first and second loops spaced circumferentially around the body, wherein each of the alternating first loops overlap adjacent alternating second loops at a transition area, wherein the method comprises moving the pin in a first loop of the slot wherein the loop defines different idling configurations of the pin and slot in which the device is inactive, and moving the pin in a second separate loop of the slot, wherein the second loop of the slot is spaced around the body from the first loop and wherein the second loop defines different configurations of the pin and slot which correspond to active and inactive configurations of the downhole device, and wherein the method includes the step of switching the pin between the first and second loops and cycling the pin between the different configurations within each of the first and second loops without switching between the first and second loops.

23. A method as claimed in claim 22, wherein the downhole device is switched from an inactive configuration to an active configuration by a) increasing fluid flow from pumps to move the pin into one end of the first loop;

b) moving the pin into a transition zone in preparation for switching the pin from the first loop to the second loop by decreasing fluid flow from pumps for a designated time, and c) increasing the fluid flow from the pumps when the pin is in the transition zone to move the pin into the second loop, thereby activating the downhole device.

24. A method as claimed in claim 23, wherein in step a) the pumps are switched from off to on; in step b) the pumps are switched from on to off; and in step c) the pumps are switched from off to on.

25. A method as claimed in claim 24, including cycling the pin repeatedly between the two different configurations of the pin and slot until the pin is switched between the loops.

26. A method as claimed in claim 25, including switching the pin between loops by reversing the relative axial direction of movement of the pin and slot.

27. A method as claimed in claim 26, wherein at least one of the loops has a transition portion adapted to switch the pin between the loops in the transition portion, wherein the transition portion incorporates a Y-junction leading between the two first and second loops, and wherein the method includes switching between loops by reversing the direction of movement of the pin relative to the slot when the pin is in the combined trunk of the Y, heading away from the junction between connecting limbs of the Y, and wherein the two limbs of the Y junction comprise parts of different respective loops.

28. A method as claimed in claim 27, including moving the pin at different speeds in the first and second tracks.

29. A method as claimed in claim 28, including moving the pin more slowly in the second track of the slot than in the first track.

30. A method as claimed in claim 29, including providing a piston responsive to pressure changes in the well, and moving the piston axially in a bore in response to said pressure changes, whereby axial movement of the piston drives the relative movement of the pin and the slot.

31. A method as claimed in claim 30, including providing multiple pairs of first and second loops, and moving the pin sequentially between each pair.

32. A method as claimed in claim 31 including providing first and second pistons, wherein the first piston carries the control slot, and the second piston is movable in the body relative to the first piston in response to fluid pressure and including using the second piston to drive the operation of the downhole device.

33. A method as claimed in claim 32, including providing a stop mechanism to restrict axial movement of the pin within the slot, restricting relative axial movement of the pin and slot in a first configuration, allowing greater relative axial movement of the pin and slot in a second configuration of the pin and slot, and including restricting the axial movement of the pin in the slot before the pin reaches the end of the slot.

34. A method as claimed in claim 33, including moving between the first and second configurations of the pin and slot by changing the rotational orientation of the slot relative to the pin.

35. A method as claimed in claim 22, wherein activation and inactivation is in accordance with the switching on and off of the surface pumps while the pin cycles in the second loop.

* * * * *